US011492943B2

(12) United States Patent
Nakamoto et al.

(10) Patent No.: US 11,492,943 B2
(45) Date of Patent: Nov. 8, 2022

(54) ENGINE FUEL REFORMING SYSTEM

(71) Applicant: Mazda Motor Corporation, Hiroshima (JP)

(72) Inventors: Yoshihisa Nakamoto, Aki-gun (JP); Takehisa Koroki, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/462,304

(22) Filed: Aug. 31, 2021

(65) Prior Publication Data

US 2022/0074334 A1 Mar. 10, 2022

(30) Foreign Application Priority Data

Sep. 9, 2020 (JP) ..... JP2020-151510

(51) Int. Cl.

| | |
|---|---|
| ***F01N 3/20*** | (2006.01) |
| ***F02M 26/14*** | (2016.01) |
| ***F02M 26/17*** | (2016.01) |
| ***F02M 26/35*** | (2016.01) |
| ***F01N 3/023*** | (2006.01) |
| ***F01N 3/10*** | (2006.01) |
| ***F02M 26/49*** | (2016.01) |
| ***F02M 26/50*** | (2016.01) |
| ***F02M 26/36*** | (2016.01) |

(52) U.S. Cl.

CPC ..... *F01N 3/2033* (2013.01); *F01N 3/023* (2013.01); *F01N 3/103* (2013.01); *F02M 26/14* (2016.02); *F02M 26/17* (2016.02); *F02M 26/35* (2016.02); *F02M 26/36* (2016.02); *F02M 26/49* (2016.02); *F02M 26/50* (2016.02)

(58) Field of Classification Search

CPC ..... F01N 3/023; F01N 3/103; F01N 3/2033; F02M 26/14; F02M 26/17; F02M 26/35; F02M 26/36; F02M 26/49; F02M 26/50

See application file for complete search history.

(56) References Cited

U.S. PATENT DOCUMENTS

2013/0333639 A1* 12/2013 Hoshino ..... F02M 27/02 123/3
2015/0075451 A1* 3/2015 Inuzuka ..... F02B 43/12 123/3

FOREIGN PATENT DOCUMENTS

JP 2006118488 A * 5/2006
JP 2014101771 A * 6/2014
JP 2018009492 A 1/2018

* cited by examiner

*Primary Examiner* — Audrey B. Walter
(74) *Attorney, Agent, or Firm* — Alleman Hall Creasman & Tuttle LLP

(57) ABSTRACT

A fuel reforming system includes a fuel injection device capable of injecting fuel into an EGR passage, a reforming catalyst provided in the EGR passage, an oxidation catalyst provided in the vicinity of the reforming catalyst in the EGR, and an air supply device that supplies air to the EGR passage. When clogging occurs in the reforming catalyst and a temperature of the reforming catalyst is less than a first temperature, air is supplied to the EGR passage by the air supply device, and fuel is injected by the fuel injection device. When clogging occurs in the reforming catalyst and the temperature of the reforming catalyst is greater than or equal to the first temperature, air is supplied to the EGR passage by the air supply device, and fuel injection of the fuel injection device is stopped.

10 Claims, 12 Drawing Sheets

ENGINE FUEL REFORMING SYSTEM

TECHNICAL FIELD

The present disclosure relates to a fuel reforming system in which a reforming catalyst capable of reforming fuel is provided in an exhaust gas recirculation (EGR) passage connecting an intake passage and an exhaust passage of an engine.

BACKGROUND ART

As an engine to which a fuel reforming system as described above is applied, an engine in JP2018-9492A below has been known. Specifically, the engine in JP2018-9492A includes an exhaust gas recirculation (EGR) passage connecting an intake passage and an exhaust passage, a fuel injection valve (fuel injection valve for reforming fuel) for injecting fuel for reforming into the EGR passage, and a reforming catalyst (fuel reforming catalyst) provided at a position of the EGR passage on the downstream side from the fuel injection valve. The reforming catalyst contains, for example, a rhodium-based catalyst metal, and has a function of reforming hydrocarbon fuel at a high temperature to generate hydrogen. Since a combustion speed of hydrogen is high, it is believed that supplying the reformed fuel containing hydrogen to an engine body (cylinder) can achieve stable combustion even under the condition that the EGR rate (the ratio of EGR gas contained in the intake air) is high, and that an effect of improving engine fuel consumption performance is obtained.

SUMMARY OF INVENTION

Problem to be Solved by the Invention

Here, the performance of the reforming catalyst gradually deteriorates as deposits such as solid carbon are deposited in the interior of the catalyst. Thus, in JP2018-9492A, a temperature at a predetermined measurement point in the reforming catalyst is measured, and when the measured temperature is higher than a predetermined degradation determination temperature, catalyst regeneration control (regeneration process) for reducing the deposits in the interior of the catalyst is executed.

JP2018-9492A does not particularly mention any specific contents of the catalyst regeneration control, but it is considered that, for regeneration of the reforming catalyst, for example, air (oxygen) is supplied to the reforming catalyst to combust and remove the deposits in the interior thereof. However, when the air supply to the reforming catalyst is continued for some time, the temperature of the reforming catalyst decreases significantly, so that the efficiency of combusting and removing the deposits might deteriorate. This leads to an increase in time required to reduce the amount of the deposits to a desired level (that is, required time for catalyst regeneration), which is not preferable.

The present disclosure has been made in view of the circumstances as described above, and an object thereof is to provide an engine fuel reforming system capable of effectively combusting and removing deposits in the interior of a reforming catalyst while the reforming catalyst is kept warm.

Means for Solving the Problem

As a solution for the problem, the present disclosure provides a fuel reforming system that is applied to an engine and reforms fuel to be supplied to an engine body. The engine includes: the engine body; an intake passage through which intake air to be introduced into the engine body flows; an exhaust passage through which exhaust gas exhausted from the engine body flows; and an exhaust gas recirculation (EGR) passage connecting the intake passage and the exhaust passage. The fuel reforming system includes: a fuel injection device capable of injecting fuel into the EGR passage; a reforming catalyst provided in the EGR passage and capable of reforming the fuel injected from the fuel injection device; an oxidation catalyst provided in a vicinity of the reforming catalyst in the EGR passage; an air supply device that supplies air to the EGR passage; a catalyst temperature sensor that detects a temperature of the reforming catalyst; a processor configured to execute: a main controller that determines whether clogging in which deposits exceeding an acceptable level are accumulated in an interior of the reforming catalyst is occurring; and a regeneration controller that controls the fuel injection device and the air supply device. When it is determined by the main controller that the clogging in the reforming catalyst is present, and the temperature of the reforming catalyst detected by the catalyst temperature sensor is less than a predetermined first temperature, the regeneration controller performs a first catalyst regeneration control for driving the air supply device so that the air is supplied to the EGR passage, and causing the fuel injection device to inject the fuel so that the fuel injected from the fuel injection device is introduced into the reforming catalyst together with the air. When it is determined by the main controller that the clogging in the reforming catalyst is present, and the temperature of the reforming catalyst is greater than or equal to the first temperature, the regeneration controller performs a second catalyst regeneration control for driving the air supply device so that the air is supplied to the EGR passage, and stopping the fuel injection by the fuel injection device.

According to the present disclosure, since the reforming catalyst and the fuel injection device are provided in the EGR passage, the fuel injected from the fuel injection device is introduced into the reforming catalyst together with EGR gas, so that the fuel can be reformed by an endothermic reaction using heat from the EGR gas (exhaust gas), and the fuel combustibility can be improved. As a result, the same effect as when discharged heat collection for reducing discharged heat from the engine to the output is performed can be obtained, and the engine fuel consumption performance can be enhanced.

However, when fuel reforming by the reforming catalyst is continued, many deposits such as solid carbon are accumulated in the interior of the reforming catalyst, which brings a concern that the performance of the reforming catalyst deteriorates significantly. To cope with this, in the present disclosure, a presence or absence of the clogging in the reforming catalyst (accumulation of the deposits exceeding the acceptable level) is determined, and when generation of the clogging is confirmed, at least the air supply device is driven by the catalyst regeneration control (first or second catalyst regeneration control) and thereby air is supplied to the reforming catalyst, so that oxygen contained in the supplied air is caused to react with the deposits in the reforming catalyst and thereby the deposits can be combusted and removed, and quick regeneration of the reforming catalyst can be achieved.

In particular, in the present disclosure, a presence or absence of fuel injection by the fuel injection device is switched according to the temperature of the reforming catalyst during the catalyst regeneration control, and thus there is an advantage that highly efficient catalyst regeneration can be achieved while the fuel consumption amount is suppressed.

That is, when the temperature of the reforming catalyst is less than the first temperature, the first catalyst regeneration control for causing the fuel injection device to inject fuel is performed; accordingly, the injection fuel from the fuel injection device is oxidized in the oxidation catalyst present in the vicinity of the reforming catalyst, so that the reforming catalyst can be heated by the reaction heat. As a result, the deposits in the reforming catalyst can be combusted and removed under a relatively high-temperature environment, so that the efficiency of combustion and removal can be maintained satisfactorily, and a time required for reducing the amount of the deposits to a desired level (that is, required time for catalyst regeneration) can be shortened.

On the other hand, when the temperature of the reforming catalyst is greater than or equal to the first temperature, the second catalyst regeneration control for stopping the fuel injection by the fuel injection device is performed, so that the fuel can be avoided from being wastefully injected in a situation where the temperature of the reforming catalyst is sufficiently high, and an increase in the fuel consumption amount in association with the catalyst regeneration can be suppressed.

Preferably, during execution of the first catalyst regeneration control, the regeneration controller progressively increases a fuel injection amount from the fuel injection device as the temperature of the reforming catalyst progressively lowers with respect to the first temperature.

According to this configuration, the reaction heat in the oxidation catalyst is increased as the range of the decrease in the temperature with respect to the first temperature increases, so that a possibility of the temperature of the reforming catalyst greatly falling below the first temperature can be reduced as much as possible, and the effect described above such as shortening of the required time for catalyst regeneration can be obtained more reliably.

In this configuration, more preferably, during execution of the first catalyst regeneration control, the regeneration controller adjusts the fuel injection amount from the fuel injection device so that a catalyst introduction equivalence ratio that is an equivalence ratio of an air-fuel mixture containing the air and the fuel to be introduced from the fuel injection device into the reforming catalyst changes according to the temperature of the reforming catalyst, and the catalyst introduction equivalence ratio is uniformly set to 1 when the temperature of the reforming catalyst is less than or equal to a second temperature that is lower than the first temperature, and is gradually reduced toward zero as the temperature of the reforming catalyst exceeding the second temperature approaches the first temperature.

According to this configuration, a suitable amount of fuel according to the temperature conditions can be caused to react in the oxidation catalyst to heat the reforming catalyst, and a suitable heat retention effect can be brought to the reforming catalyst while the fuel consumption amount is suppressed to the necessary minimum.

Here, desirably, the first temperature is higher than an activation temperature of the reforming catalyst.

According to this configuration, the reaction heat in the oxidation catalyst can be exerted on the reforming catalyst before the temperature of the reforming catalyst decreases to the activation temperature, and the possibility of the reforming catalyst falling below the activation temperature can be reduced as much as possible. As a result, after the end of the catalyst regeneration control, shifting to the control for reforming fuel in the reforming catalyst can be made quickly, so that as long a time as possible for performing an operation using reformed fuel excellent in combustibility can be secured, and the engine fuel consumption performance can be improved sufficiently.

Preferably, the air supply device includes an exhaust turbine device including an impeller provided in the exhaust passage and a motor generator coupled to the impeller, and an EGR valve configured to open and close, provided in the EGR passage, the reforming catalyst is provided adjacent to an exhaust side of the oxidation catalyst, and during performance of the first and second catalyst regeneration control, the regeneration controller opens the EGR valve and causes the motor generator to work as a motor.

As described above, at the time of the catalyst regeneration control, when the EGR valve is opened and the motor generator of the exhaust turbine device is caused to work as a motor, there is an advantage that the fuel consumption performance can be satisfactorily secured while an air flow for catalyst regeneration (combustion and removal of the deposits) is suitably generated.

That is, during the catalyst regeneration control, when the motor generator works as a motor, the impeller coupled to the motor generator rotates in the exhaust passage at a high speed to draw exhaust gas in the exhaust passage and send the exhaust gas to the downstream side. As a result, the pressure of the exhaust passage decreases, and an air flow reaching the exhaust passage from the intake passage through the EGR passage (that is, flowing back through the EGR passage) is generated, so that oxygen contained in the air flow can be caused to react with the deposits in the reforming catalyst to combust and remove the deposits.

Furthermore, the oxidation catalyst and the reforming catalyst are disposed adjacent to each other in this order from the intake side, so that when the catalyst regeneration control associated with fuel injection (first catalyst regeneration control) is executed, the reaction heat that occurs due to oxidization of the injected fuel in the oxidization catalyst can be effectively exerted on the reforming catalyst present on the downstream side in the air flow direction, and the effect of keeping the reforming catalyst warm can be enhanced.

On the other hand, when the catalyst regeneration control (first and second catalyst regeneration controls, collectively) is unnecessary, the motor generator is caused to work as a generator, so that part of energy of the exhaust gas can be collected as electric power. This enhances the efficiency of discharged heat collection for reducing discharged heat from the engine to the output, in cooperation with the effect of fuel reforming due to the endothermic reaction in the reforming catalyst (improvement of the combustibility). Furthermore, the electric power thus collected from the energy of the exhaust gas can be supplied to the motor generator that works as a motor during the catalyst regeneration control, and thus as opposed to when, for example, only electric power generated by an alternator associated with an output shaft of the engine body (that is, electric power directly obtained from the engine output) is the electric power source, an influence of energy consumption during the catalyst regeneration control on the fuel consumption performance can be minimized.

The fuel injection device can include a reforming injector provided at a portion of the EGR passage on an exhaust side from the reforming catalyst, and a regeneration injector provided at a portion of the EGR passage on an intake side from the oxidation catalyst. In this case, preferably, during execution of the first catalyst regeneration control, the regeneration controller stops fuel injection of the reforming injector and causes the regeneration injector to inject fuel.

As described above, during performance of the first catalyst regeneration control, when fuel is injected from the regeneration injector located on the intake side from the oxidation catalyst, the injection fuel from the regeneration injector can be introduced into the oxidation catalyst together with air flowing through the EGR passage from the intake side to the exhaust side, and the reforming catalyst can be suitably heated by oxidation reaction heat of the fuel that occurs in the oxidation catalyst. On the other hand, when the catalyst regeneration control is unnecessary, fuel is injected from the reforming injector located on the exhaust side from the reforming catalyst, so that the injection fuel from the reforming injector can be introduced into the reforming catalyst together with EGR gas flowing through the EGR passage from the exhaust side to the intake side and reformed.

Advantageous Effect of Invention

As described above, according to the engine fuel reforming system of the present disclosure, the deposits in the interior of the reforming catalyst can be effectively combusted and removed while the reforming catalyst is kept warm.

BRIEF DESCRIPTION OF DRAWINGS

FIGS. 10A and 10B are graphs illustrating a tendency of a map for determining a reforming fuel injection amount, in which FIG. 10A illustrates a relationship between a catalyst temperature and a reforming fuel injection amount and FIG. 10B illustrates a relationship between an EGR gas flow rate and a reforming fuel injection amount.

MODE FOR CARRYING OUT THE INVENTION (1) Overall Configuration of Engine

Figure 1:
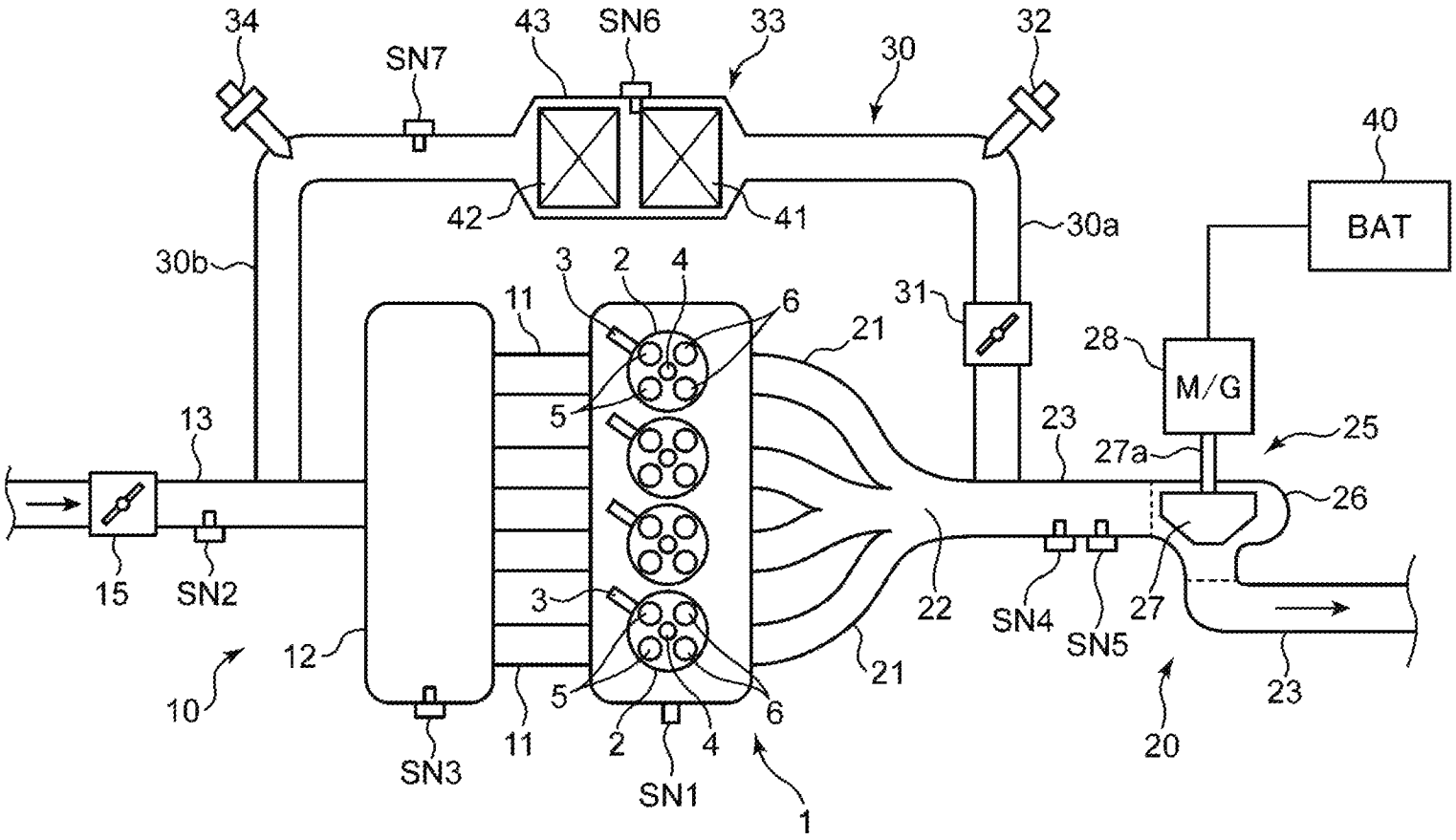
FIG. 1 is a plan view schematically illustrating an overall configuration of an engine to which a fuel reforming system according to an embodiment of the present disclosure is applied.

FIG. 1 is a plan view schematically illustrating an overall configuration of an engine to which a fuel reforming system according to an embodiment of the present disclosure is applied. The engine illustrated in this figure is a four-cycle gasoline engine mounted on a vehicle as a power source for traveling and includes an engine body 1, an intake passage 10 through which intake air to be introduced into the engine body 1 flows, an exhaust passage 20 through which exhaust gas exhausted from the engine body 1 (burned gas) flows, and an exhaust gas recirculation (EGR) passage 30 connecting the intake passage 10 and the exhaust passage 20.

The engine body 1 is of an in-line multi-cylinder type including a plurality of (here, four) cylinders 2 arranged in a row. An unillustrated piston is housed in each of the cylinders 2 so as to be capable of reciprocating therein.

Each of the cylinders 2 of the engine body 1 is provided with a direct injector 3, a spark plug 4, an intake valve 5, and an exhaust valve 6. The direct injector 3 is an injection valve that injects fuel (hydrocarbon fuel) containing gasoline into the cylinder 2. The spark plug 4 is a plug that ignites an air-fuel mixture in which fuel and air are mixed. The intake valve 5 is a valve that opens and closes an unillustrated intake port providing communication between the intake passage 10 (each independent intake pipe 11 described later) and the cylinder 2. The exhaust valve 6 is a valve that opens and closes an unillustrated exhaust port providing communication between the exhaust passage 20 (each independent exhaust pipe 21 described later) and the cylinder 2.

The fuel supplied from the direct injector 3 to the cylinder 2 is mixed with air in the interior of the cylinder 2 (combustion chamber), forming an air-fuel mixture. Combustion of the air-fuel mixture occurs as a result of ignition caused by the spark plug 4, and the piston receives an expansion force due to the combustion to reciprocate. Reciprocation of the piston is transmitted to an output shaft (crankshaft) of the engine body 1 via an unillustrated crank mechanism to rotate the output shaft. The engine body 1 is provided with a crank angle sensor SN1 that detects a rotation angle (crank angle) and rotation speed (engine rotation speed) of the output shaft. It should be noted that in this embodiment, in addition to the fuel supplied from the direct injector 3 (or instead of this), fuel supplied from a reforming injector 32 through the EGR passage 30 may be combusted in the cylinder 2 (which will be described later in detail).

The intake passage 10 has a plurality of (here, four) the independent intake pipes 11 connected to one side surface of the engine body 1, a surge tank 12 to which an end part of each of the independent intake pipes 11 on the upstream side (the side far from the engine body 1) is connected commonly, and a common intake pipe 13 having a single pipe shape and extending from the surge tank 12 toward the upstream side. Each of the independent intake pipes 11 is connected to the engine body 1 so as to communicate with each of the cylinders 2 via the intake port.

A throttle valve 15 for adjusting an intake air flow rate by being openable and closable is provided at an intermediate part of the common intake pipe 13. Furthermore, an intake air pressure sensor SN2 that detects a pressure of intake air is provided at a position of the common intake pipe 13 on the downstream side from the throttle valve 15. The intake air pressure sensor SN2 is provided at the position on the upstream side from a connection part between the EGR passage 30 and the intake passage 10 (common intake pipe 13) and on the downstream side from the throttle valve 15 so that the intake air pressure sensor SN2 can detect a pressure of intake air before EGR gas is mixed therewith (that is, fresh air). It should be noted that a combination of the intake air pressure sensor SN2 and an exhaust gas pressure sensor SN4 described later is an example of a "differential pressure detector" in the present disclosure.

The surge tank 12 is provided with an air flow sensor SN3 that detects a flow rate of intake air flowing through the surge tank 12. Here, when EGR gas (exhaust gas returned from the exhaust passage 20 through the EGR passage 30) is introduced into the intake passage 10, the intake air flowing through the surge tank 12 is mixed gas in which fresh air from the common intake pipe 13 and EGR gas from the EGR passage 30 are mixed. In this case, the air flow sensor SN3 detects a flow rate of the mixed gas flowing through the surge tank 12.

The exhaust passage 20 has a plurality of (here, four) the independent exhaust pipes 21 connected to the other side surface of the engine body 1, a collector 22 in which end parts of the respective independent exhaust pipes 21 on the downstream side (the side far from the engine body 1) are collected, and a common exhaust pipe 23 having a single pipe shape and extending from the collector 22 toward the downstream side. Each of the independent exhaust pipes 21 is connected to the engine body 1 so as to communicate with each of the cylinders 2 via the exhaust port.

An exhaust turbine device 25 is provided at an intermediate part of the common exhaust pipe 23. The exhaust turbine device 25 has a turbine case 26 provided at an intermediate part of the common exhaust pipe 23, an impeller 27 disposed in the interior of the turbine case 26, and a motor generator 28 coupled to the impeller 27 via a coupling shaft 27*a*.

The motor generator 28 is an electric device having a function of both of a motor and a generator. That is, the motor generator 28 can work as a generator that converts rotation energy of the impeller 27 into electric power and also can work as a motor that rotationally drives the impeller 27.

The impeller 27 exhibits functions different according to working situations of the motor generator 28. That is, when the motor generator 28 works as a generator, the impeller 27 functions as a turbine and receives energy of exhaust gas passing through the turbine case 26 to rotate passively. The rotation of the impeller 27 is transmitted to the motor generator 28 and converted into electric power in the motor generator 28. On the other hand, when the motor generator 28 works as a motor, the impeller 27 functions as a compressor and actively rotates so that exhaust gas is sent to the downstream side.

The motor generator 28 is electrically connected to a battery 40. The battery 40 can store electric power generated in the motor generator 28 when the motor generator 28 works as a generator, and supply the electric power to the motor generator 28 when the motor generator 28 works as a motor.

The exhaust gas pressure sensor SN4 that detects a pressure of exhaust gas and an $O_2$ sensor SN5 (oxygen sensor) that detects a concentration of oxygen contained in the exhaust gas are provided at a position of the common exhaust pipe 23 on the upstream side from the exhaust turbine device 25 (turbine case 26). The exhaust gas pressure sensor SN4 and the $O_2$ sensor SN5 are disposed in parallel such that the exhaust gas pressure sensor SN4 is located slightly on the upstream side from the $O_2$ sensor SN5 between a connection part between the EGR passage 30 and the exhaust passage 20 (common exhaust pipe 23) and the exhaust turbine device 25.

The EGR passage 30 is provided so as to couple together a position of the common exhaust pipe 23 on the upstream side from the exhaust gas pressure sensor SN4 and a position of the common intake pipe 13 on the downstream side from the intake air pressure sensor SN2. In the EGR passage 30, an EGR valve 31, the reforming injector 32, a catalyst converter 33, and a regeneration injector 34 are arranged in this order from the exhaust side (the side close to the exhaust passage 20). Hereinafter, a portion of the EGR passage 30 on the exhaust side from the catalyst converter 33 is referred to as a first EGR passage part 30*a*, and a portion of the EGR passage 30 on the intake side from the catalyst converter 33 (the side close to the intake passage 10) is referred to as a second EGR passage part 30*b*.

The EGR valve 31 is an openable and closeable valve provided to adjust a flow rate of EGR gas that is exhaust gas returned from the exhaust passage 20 to the intake passage 10 through the EGR passage 30 (first and second EGR passage parts 30*a* and 30*b*). The EGR valve 31 is provided in the first EGR passage part 30*a* located on the exhaust side from the catalyst converter 33.

The catalyst converter 33 has a reforming catalyst 41, an oxidation catalyst 42, and a catalyst case 43 that houses both of the catalysts 41 and 42. The reforming catalyst 41 and the oxidation catalyst 42 are disposed in proximity to each other such that the reforming catalyst 41 is located on the intake side from the oxidation catalyst 42 (the side close to the intake passage 10).

The reforming injector 32 and the regeneration injector 34 are injection valves that inject the same fuel as the fuel injected by the direct injector 3, that is, hydrocarbon fuel containing gasoline. It should be noted that a combination of the reforming injector 32 and the regeneration injector 34 is an example of a "fuel injection device" in the present disclosure.

The reforming injector 32 is provided in the first EGR passage part 30*a* located on the exhaust side from the catalyst converter 33. The reforming injector 32 injects fuel into the first EGR passage part 30*a* to reform the injected fuel in the reforming catalyst 41. At the time of this fuel injection of the reforming injector 32, an operation (exhaust gas return operation) for causing EGR gas to flow from the exhaust passage 20 to the intake passage 10 through the EGR passage 30 is performed (see FIG. 13), which will be described later in detail. The fuel injected from the reforming injector 32 into the first EGR passage part 30*a* is introduced into the reforming catalyst 41 together with the EGR gas flowing toward the intake side through the first EGR passage part 30*a*.

The regeneration injector 34 is provided in the second EGR passage part 30*b* located on the intake side from the catalyst converter 33. The regeneration injector 34 injects fuel into the second EGR passage part 30*b* for the purpose of catalyst regeneration for reducing deposits in the reforming catalyst 41. At the time of this fuel injection of the regeneration injector 34, an operation of causing air to flow from the intake passage 10 to the exhaust passage 20 through the EGR passage 30 (that is, in the opposite direction of the EGR gas) is performed (see FIG. 14), which will be described later in detail. The fuel injected from the regeneration injector 34 into the second EGR passage part 30*b* is introduced into the oxidation catalyst 42 together with the air flowing toward the exhaust side through the second EGR passage part 30*b*.

The reforming catalyst 41 has a porous carrier (monolith carrier) having, for example, a honeycomb structure, and a catalyst substance (reforming catalyst substance) coated on a surface of the carrier for fuel reforming. The reforming catalyst substance contains, for example, a rhodium-based (Rh) catalyst metal, and has a function of reforming fuel passing through the reforming catalyst 41. Specifically, the reforming catalyst substance has a function of, at the time of fuel injection of the reforming injector 32, reforming fuel containing gasoline (hydrocarbon fuel) injected from the reforming injector 32 and introduced into the reforming catalyst 41 together with EGR gas, and generating components containing hydrogen ($H_2$) and carbon monoxide (CO).

The oxidation catalyst 42 has a porous carrier (monolith carrier) having, for example, a honeycomb structure, and a catalyst substance (oxidation catalyst substance) coated on a surface of the carrier for fuel oxidation. The oxidation catalyst substance contains, for example, catalyst metal such as platinum (Pt) and palladium (Pd), and has a function of oxidizing fuel passing through the oxidation catalyst 42. Specifically, the oxidation catalyst substance has a function of, at the time of fuel injection of the regeneration injector 34, causing unburned components of fuel injected from the regeneration injector 34 and introduced into the oxidation catalyst 42 to react with oxygen in air introduced into the oxidation catalyst 42 together with the unburned components, and oxidizing the unburned components.

The catalyst converter 33 is provided with a catalyst temperature sensor SN6 that detects a temperature of the reforming catalyst 41. The catalyst temperature sensor SN6 is attached to a position corresponding to an end part of the reforming catalyst 41 on the intake side. This temperature detection position of the catalyst temperature sensor SN6 corresponds to a position at which EGR gas flowing from the exhaust side to the intake side exits from the reforming catalyst 41, that is, an outlet of the reforming catalyst 41.

The second EGR passage part 30*b* is provided with a hydrogen sensor SN7 that detects a concentration of hydrogen contained in EGR gas flowing through the second EGR passage part 30*b*. The hydrogen sensor SN7 is attached to a position of the second EGR passage part 30*b* on the exhaust side from the regeneration injector 34 (between the regeneration injector 34 and the oxidation catalyst 42).

(2) Control System

Figure 2:
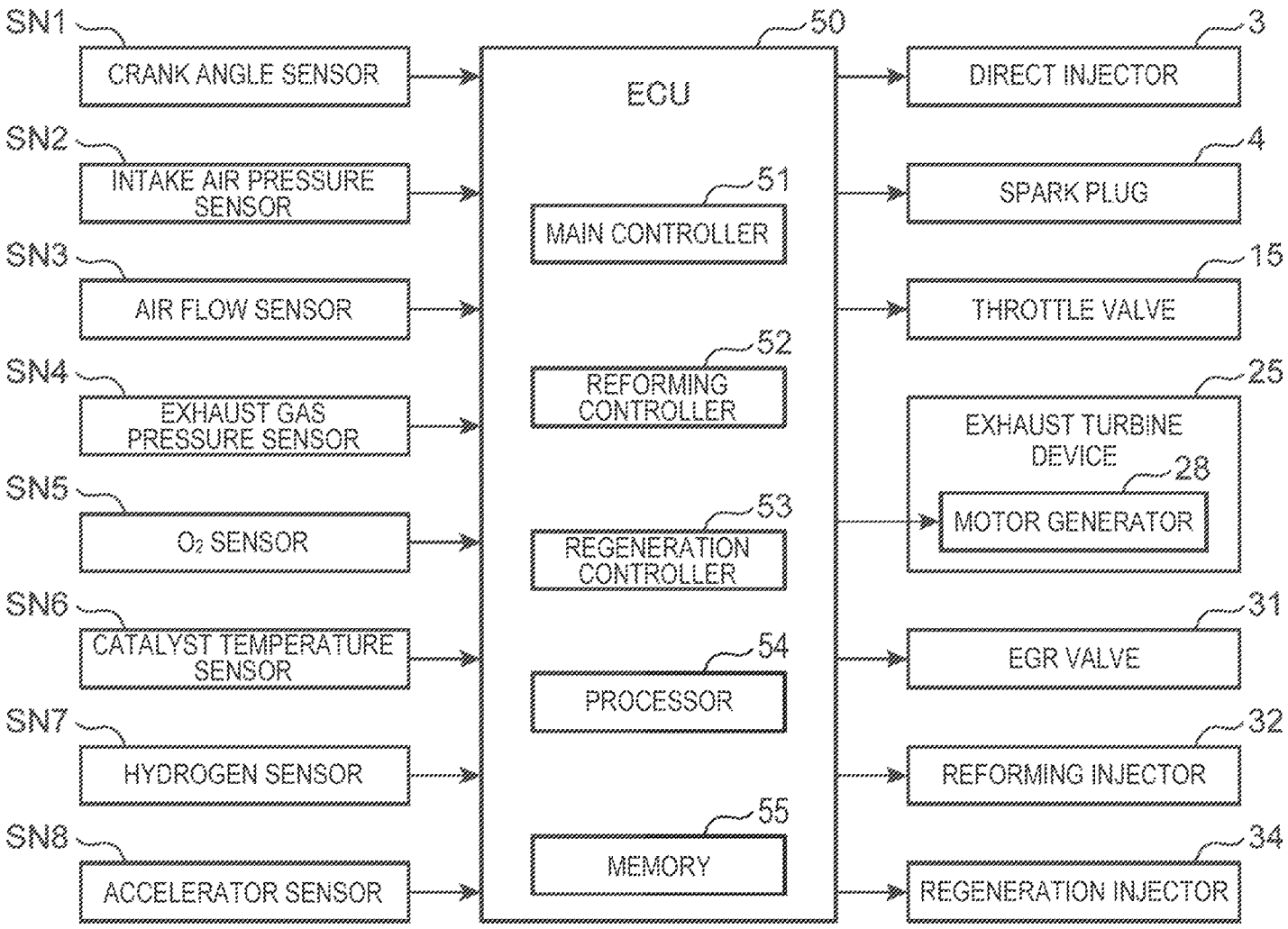
FIG. 2 is a block diagram illustrating a control system of the engine.

FIG. 2 is a block diagram of a control system of the engine of this embodiment. An engine control unit (ECU) 50 illustrated in this figure is a microcomputer for performing overall control of the engine and includes a well-known processor (i.e., a central processing unit (CPU)) 54, memory 55 such as ROM and/or RAM, and the like.

The ECU 50 receives information detected by various sensors. For example, the ECU 50 is electrically connected to the crank angle sensor SN1, the intake air pressure sensor SN2, the air flow sensor SN3, the exhaust gas pressure sensor SN4, the $O_2$ sensor SN5, the catalyst temperature sensor SN6, and the hydrogen sensor SN7, and the ECU 50 sequentially receives information detected by these sensors (that is, information such as an crank angle, an engine rotation speed, an intake air pressure, an intake air flow rate, an exhaust gas pressure, an oxygen concentration, a catalyst temperature, and a hydrogen concentration).

Furthermore, the vehicle is provided with an accelerator sensor SN8 that detects an opening of an accelerator pedal (accelerator opening) operated by a driver who drives the vehicle, and the ECU 50 also sequentially receives a signal detected by the accelerator sensor SN8.

The ECU 50 controls various parts of the engine while executing various determination, computation, and the like based on input signals from the respective sensors SN1 to SN8. That is, the ECU 50 is electrically connected to the direct injector 3, the spark plug 4, the throttle valve 15, the motor generator 28 of the exhaust turbine device 25, the EGR valve 31, the reforming injector 32, the regeneration injector 34, and the like, and outputs control signals to these respective devices based on results of the computation and the like.

The ECU 50 has a main controller 51, a reforming controller 52, and a regeneration controller 53 executed by the processor 54 to perform their respective functions and are stored in the memory 55 as software modules. The reforming controller 52 is a control module that performs fuel reforming control for supplying fuel reformed in the reforming catalyst 41 to the engine body 1. The regeneration controller 53 is a control module that performs catalyst regeneration control for reducing deposits in the reforming catalyst 41. The main controller 51 is a control module that performs various control and determination other than the fuel reforming control and the catalyst regeneration control.

(3) Control Operations

Next, an example of control operations executed by the ECU 50 during operation of the engine will be described with reference to flowcharts of FIGS. 3 to 6.

Figure 3:
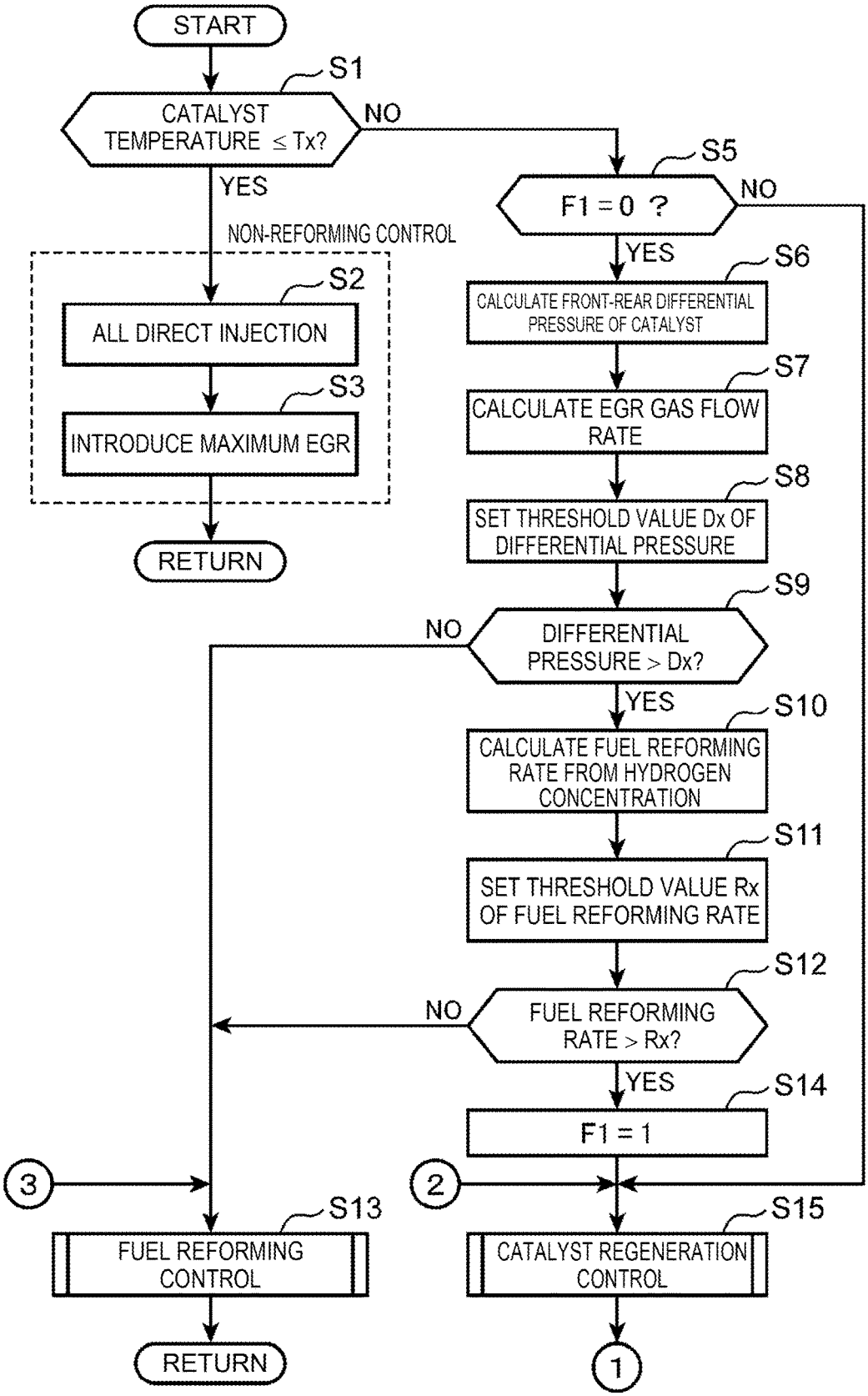
FIG. 3 is a flowchart illustrating a first half of control executed during operation of the engine.

When control illustrated in FIG. 3 starts, the main controller 51 of the ECU 50 determines whether the temperature of the reforming catalyst 41 detected by the catalyst temperature sensor SN6 is less than or equal to a predefined threshold value Tx (step S1). The threshold value Tx is set to a value in the vicinity of an activation temperature of the reforming catalyst 41 (for example, about 500° C.).

When the determination is YES in step S1 and it is confirmed that the temperature of the reforming catalyst 41 is less than or equal to the threshold value Tx, the main controller 51 executes non-reforming control for stopping fuel reforming of the reforming catalyst 41. The non-reforming control includes the following steps S2 and S3.

First, in step S2, the main controller 51 controls the reforming injector 32 and the direct injectors 3 so that the fuel to be supplied to each of the cylinders 2 is all covered by injection fuel from each of the direct injectors 3. That is, the ECU 50 causes the direct injector 3 of each of the cylinders 2 to inject the same amount of fuel as the total amount of the fuel to be supplied to each of the cylinders 2 and stops the fuel injection by the reforming injector 32.

In the subsequent step S3, the main controller 51 controls the EGR valve 31 so that the EGR rate that is a ratio of EGR gas to intake air (fresh air and EGR gas) to be introduced into each of the cylinders 2 becomes the maximum within a range in which a necessary combustion stability is secured. That is, an upper limit of the EGR rate that can be set when all of the fuel supplied to the cylinder 2 is from the direct injector 3 (that is, fuel that is not reformed) can be preset for each operational condition under the condition that the combustion stability is not impaired. In the ECU 50, such an upper limit of the EGR rate (the upper limit of the EGR rate that can be set in a case of all direct injection) is stored in advance for each operational condition. The ECU 50 adjusts the opening of the EGR valve 31 so that the stored upper limit of the EGR rate is realized.

Next, a description will be given of control when the determination in step S1 is NO, that is, when the temperature of the reforming catalyst 41 exceeds the threshold value Tx. In this case, the main controller 51 determines whether the value of a clogging determination flag F1 is "0" (step S5). The clogging determination flag F1 is a flag representing a degree of clogging occurring in the reforming catalyst 41, which is "1" when determination in steps S9 and S12 described later is both YES and is "0" otherwise. The clogging determination flag F1 being "1" means that the amount of deposits such as solid carbon deposited in the interior of the reforming catalyst 41 exceeds the acceptable level (clogging is occurring), and the flag F1 being "0" means that the amount of the deposits does not exceed the acceptable level (clogging is not occurring).

When the determination is YES in step S5 and it is confirmed that the clogging determination flag F1=0 (clogging is not occurring), the main controller 51 calculates a front-rear differential pressure of the catalyst converter 33 (the reforming catalyst 41 and the oxidation catalyst 42) including the reforming catalyst 41 (step S6). That is, the main controller 51 subtracts the pressure of the intake passage 10 (common intake pipe 13) detected by the intake air pressure sensor SN2 from the pressure of the exhaust passage 20 (common exhaust pipe 23) detected by the exhaust gas pressure sensor SN4 and identifies the value obtained by the subtraction as the front-rear differential pressure of the catalyst converter 33.

Here, the pressure detected by the exhaust gas pressure sensor SN4 is substantially the same as the pressure of an end part of the first EGR passage part 30*a* on the upstream side (exhaust side), and the pressure detected by the intake air pressure sensor SN2 is substantially the same as the pressure of an end part of the second EGR passage part 30*b* on the downstream side (intake side). Thus, in step S6, calculating the value in which the pressure detected by the intake air pressure sensor SN2 is subtracted from the pressure detected by the exhaust gas pressure sensor SN4 corresponds to detecting a value in which the pressure of the downstream end of the second EGR passage part 30*b* (lead-out passage) is subtracted from the pressure of the upstream end of the first EGR passage part 30*a* (introduction passage), in other words, a differential pressure between an inlet and outlet of the EGR passage 30. On the other hand, under the precondition that step S6 is reached, that is, under the condition that the determination in step S1 is NO and the determination in step S5 is YES (the catalyst temperature >Tx and the clogging determination flag F1=0), the fuel reforming control is executed in step S13 described later, and the EGR gas is caused to flow from the exhaust side to the intake side in a state where the EGR valve 31 is fully open. Since the EGR valve 31 is fully open, the pressure of the EGR gas decreases mainly by passing through the catalyst converter 33. In other words, the pressure loss (the amount of decrease in pressure) that occurs in a portion of the EGR passage 30 other than where the catalyst converter 33 is present is sufficiently smaller than the pressure loss that occurs in the catalyst converter 33. This means that the differential pressure between the inlet and outlet of the EGR passage 30 can be used as a value representing the pressure loss (front-rear differential pressure) in the catalyst converter 33. Thus, in this embodiment, the value in which the pressure detected by the intake air pressure sensor SN2 is subtracted from the pressure detected by the exhaust gas pressure sensor SN4 (that is, the differential pressure between the inlet and outlet of the EGR passage 30) is identified as the front-rear differential pressure of the catalyst converter 33.

Next, the main controller 51 calculates a flow rate of the EGR gas flowing through the EGR passage 30 (step S7). Specifically, the main controller 51 estimates an intake air amount that is a flow rate of the intake air (fresh air) flowing through the common intake pipe 13, based on the pressure detected by the intake air pressure sensor SN2, and identifies a value in which the estimated intake air amount is subtracted from the flow rate in the surge tank 12 detected by the air flow sensor SN3, as the flow rate of the EGR gas. That is, since what is flowing through the surge tank 12 is mixed gas in which the fresh air and the EGR gas are mixed, the value in which the flow rate of the fresh air flowing through the common intake pipe 13 (the estimated value based on the intake air pressure sensor SN2) is subtracted from the flow rate of the mixed gas flowing through the surge tank 12 (the value detected by the air flow sensor SN3) corresponds to the flow rate of the EGR gas.

Figure 7:
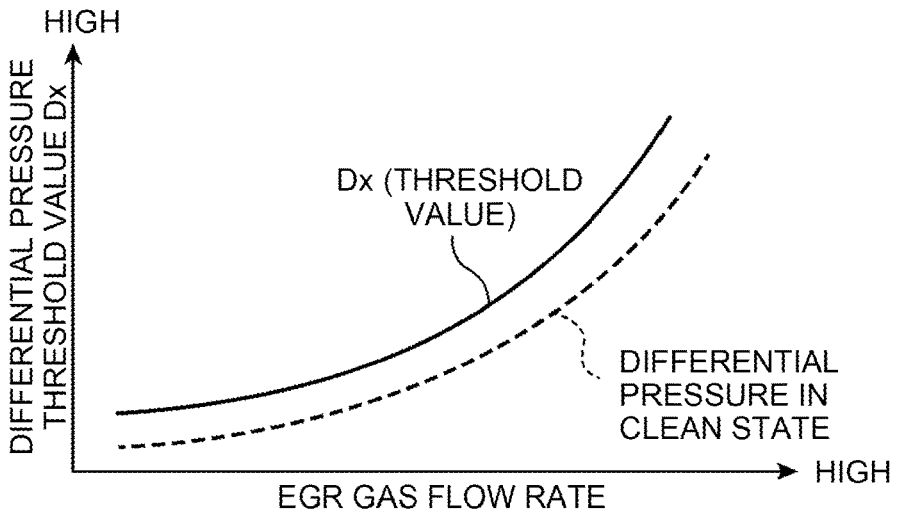
FIG. 7 is a graph illustrating a relationship between a threshold value of a differential pressure used in determination in step S9 of FIG. 3 and an exhaust gas recirculation (EGR) gas flow rate.

Next, the main controller 51 sets a threshold value Dx that is compared with the front-rear differential pressure of the catalyst converter 33 in step S9 described later (step S8). FIG. 7 is a graph illustrating a tendency of the threshold value Dx. As illustrated in this figure, the threshold value Dx of the differential pressure is set so as to increase as the flow rate of the EGR gas flowing through the EGR passage 30 increases. That is, the main controller 51 determines the threshold value Dx of the differential pressure by applying the flow rate of the EGR gas calculated in step S7 to a map corresponding to the graph of FIG. 7 (solid-line waveform). Here, the threshold value Dx is set to a value larger to some extent than a front-rear differential pressure (broken-line waveform) that occurs when the catalyst converter 33 is as clean as new. The front-rear differential pressure of the catalyst converter 33 becoming larger than the front-rear differential pressure thereof in the clean state is mainly caused by accumulation of deposits such as solid carbon that occurs in association with the fuel reforming reaction in the reforming catalyst 41. Thus, comparing the front-rear differential pressure of the catalyst converter 33 with the threshold value Dx of FIG. 7 means determination of the extent of the deposits present in the reforming catalyst 41.

Next, the main controller 51 determines whether the front-rear differential pressure of the catalyst converter 33 calculated in step S6 is larger than the threshold value Dx set in step S8 (step S9).

When the determination is YES in step S9 and it is confirmed that the front-rear differential pressure of the catalyst converter 33 is larger than the threshold value Dx, the main controller 51 calculates a fuel reforming rate based on the hydrogen concentration detected by the hydrogen sensor SN7 or the like (step S10). Here, the fuel reforming rate is a ratio of the fuel reformed in the reforming catalyst 41 to the fuel injected from the reforming injector 32. As described above, the fuel injected from the reforming injector 32 is reformed into components containing hydrogen ($H_2$) through the reforming reaction in the reforming catalyst 41. Thus, the hydrogen concentration in the EGR gas flowing on the downstream side of the reforming catalyst 41 (second EGR passage part 30*b*), that is, the hydrogen concentration detected by the hydrogen sensor SN7 increases as the fuel reforming rate of the reforming catalyst 41 increases, and increases as the fuel injection amount from the reforming injector 32 increases. The main controller 51 calculates the fuel reforming rate based on the value detected by the hydrogen sensor SN7 and the fuel injection amount from the reforming injector 32.

Next, the main controller 51 sets a threshold value Rx that is compared with the fuel reforming rate in step S12 described later (step S11). The threshold value Rx of the fuel reforming rate is set to a value lower to some extent than a maximum reforming rate that is a maximum rate of the fuel reforming rate obtainable in the current operational condition. In this embodiment, the EGR rate is adjusted for each operational condition so that the fuel reforming rate becomes the maximum reforming rate described above, which will be described in detail in the fuel reforming control described later (step S13 or steps S30 to S36 of FIG. 5). The decrease in the fuel reforming rate with respect to the maximum reforming rate is mainly caused by accumulation of deposits such as solid carbon that occurs in association with the fuel reforming reaction in the reforming catalyst 41. Thus, comparing the fuel reforming rate with the threshold value Rx means determination of the extent of the deposits present in the reforming catalyst 41.

When the determination in either step S12 or step S9 is NO, that is, when the front-rear differential pressure of the catalyst converter 33 is less than or equal to the threshold value Dx or when the fuel reforming rate is greater than or equal to the threshold value Rx, the reforming controller 52 of the ECU 50 executes control for injecting fuel into the reforming injector 32 while causing the EGR gas (exhaust gas) to flow through the EGR passage 30 (step S13), as the fuel reforming control. This fuel reforming control will be described later in detail.

On the other hand, when the determination in step S12 is YES, the main controller 51 inputs "1" into the clogging determination flag F1 (step S14). That is, the fact that the determination in step S12 is YES (as a premise thereof, the determination in step S9 is also YES) means that the fuel reforming rate is less than the threshold value Rx and the front-rear differential pressure of the catalyst converter 33 exceeds the threshold value Dx. These events all provide a basis for estimating that there are many deposits in the reforming catalyst 41. Thus, the main controller 51 performs the setting in step S14 in which the clogging determination flag F1=1, and records that the amount of the deposits in the reforming catalyst 41 exceeds the acceptable level.

Next, the regeneration controller 53 of the ECU 50 executes control for combusting the deposits in the reforming catalyst 41 by supplying air to the reforming catalyst 41 through the EGR passage 30, as the catalyst regeneration control (step S15). This catalyst regeneration control will be described later in detail.

Figure 5:
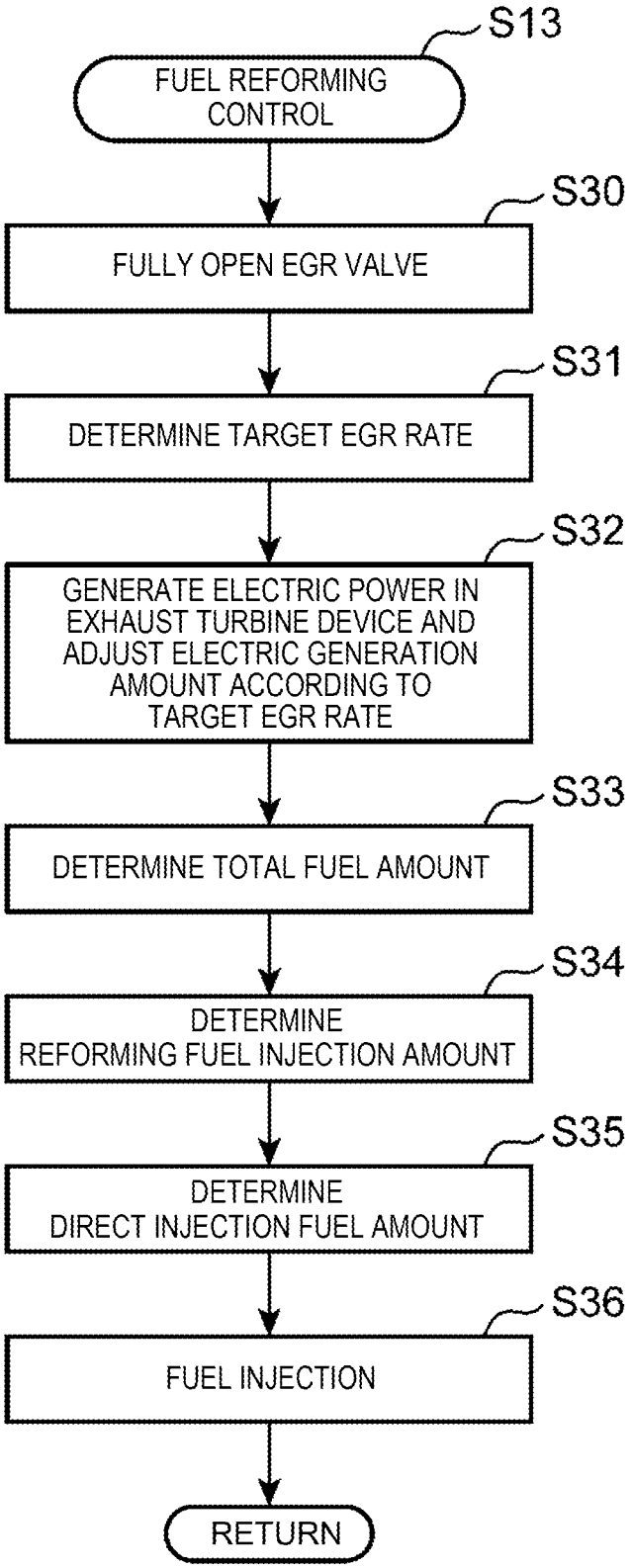
FIG. 5 is a subroutine illustrating details of fuel reforming control performed in step S13 of FIG. 3.
Figure 13:
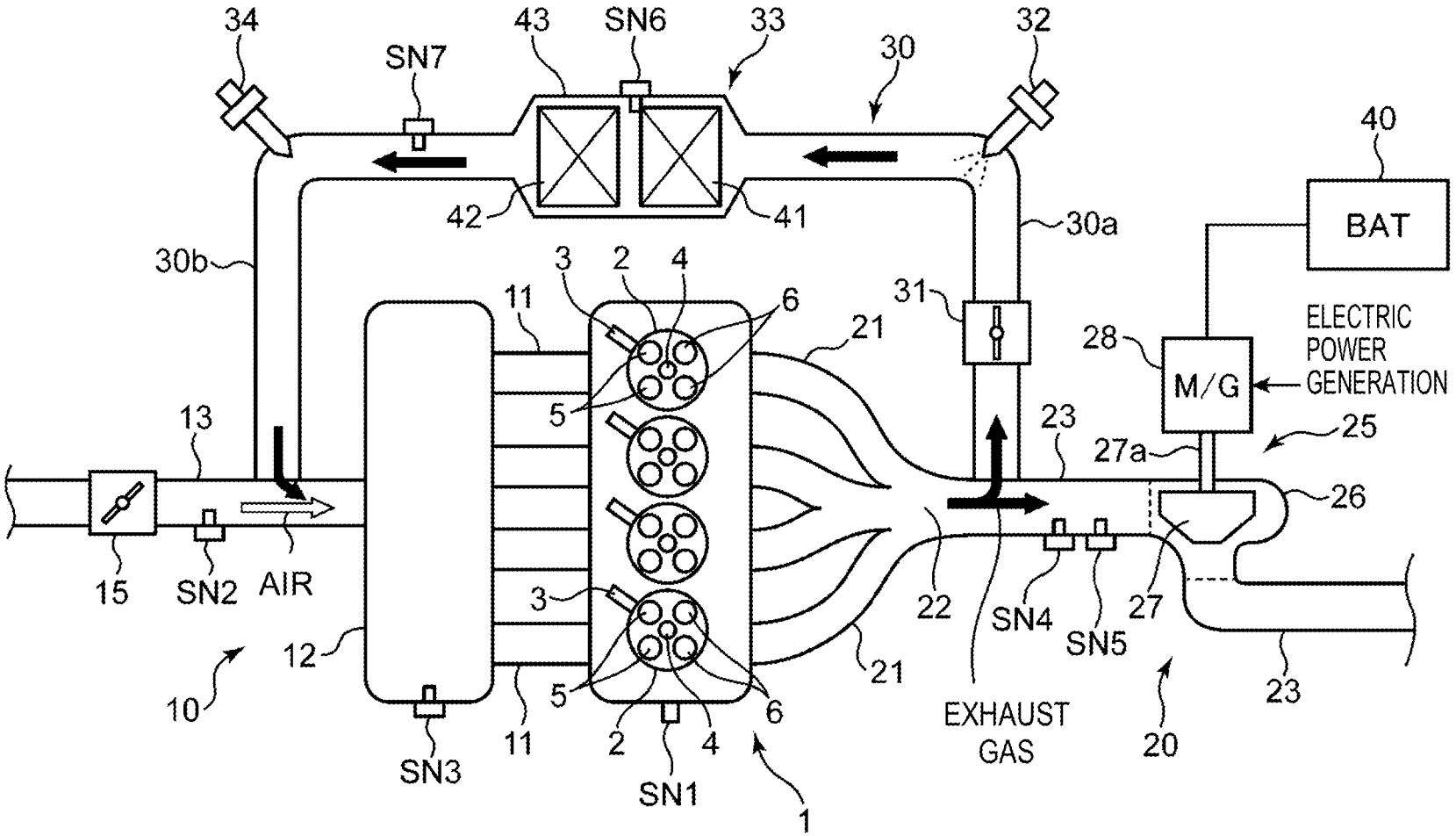
FIG. 13 is an explanatory view illustrating a flow of each passage during the fuel reforming control.

FIG. 5 is a subroutine illustrating details of the fuel reforming control in step S13. When the control illustrated in FIG. 5 starts, the reforming controller 52 opens the EGR valve 31 to a fully open position (step S30). Here, in the fuel reforming control, the motor generator 28 of the exhaust turbine device 25 works as a generator in step S32 described later. As a result, the impeller 27 of the exhaust turbine device 25 becomes a resistance element that hinders the circulation of the exhaust gas, and the pressure of the exhaust passage 20 becomes sufficiently higher than the pressure of the intake passage 10. In this state, the EGR valve 31 is fully opened as described above, thereby generating a flow of exhaust gas flowing from the exhaust passage 20 to the intake passage 10 through the EGR passage 30 as illustrated in FIG. 13. That is, the exhaust gas return operation is realized in which a part of the exhaust gas flowing through the exhaust passage 20 is returned to the intake passage 10 as EGR gas.

Next, the reforming controller 52 determines a target EGR rate that is a target value of the EGR rate (a ratio of the EGR gas to the intake air) (step S31). The target EGR rate is predefined in, for example, a map format so as to take a value different for each engine operational condition (the load and the rotation speed). The reforming controller 52 determines the target EGR rate that conforms to the current operational condition based on the engine load identified from the detection value of the accelerator sensor SN8 or the like and the engine rotation speed identified from the detection value of the crank angle sensor SN1.

Figure 8:
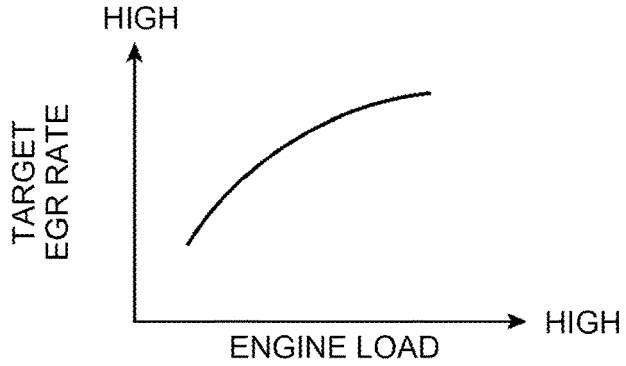
FIG. 8 is a graph illustrating a relationship between an engine load and a target EGR rate.

FIG. 8 is a graph illustrating a relationship between the engine load and the target EGR rate. As illustrated in this figure, the target EGR rate is set so as to increase as the engine load increases. Such a tendency of the target EGR rate is defined for achieving effective fuel reforming in the reforming catalyst 41.

Figure 9:
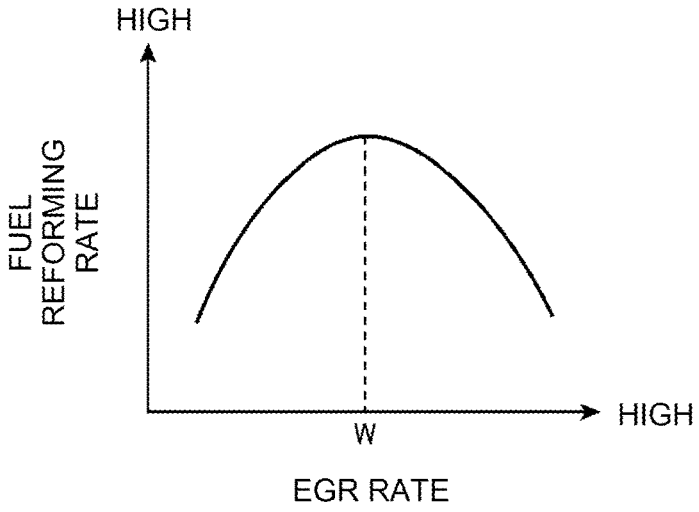
FIG. 9 is a graph illustrating a relationship between an EGR rate and a fuel reforming rate.

FIG. 9 is a graph illustrating a characteristic of the fuel reforming rate that forms the basis of defining the tendency of the target EGR rate described above. The fuel reforming rate is, as already described, a ratio of the fuel reformed in the reforming catalyst 41 to the fuel injected from the reforming injector 32. As illustrated in FIG. 9, when conditions other than the EGR rate (the load, the rotation speed, the catalyst temperature, and the like) are the same, the fuel reforming rate increases or decreases according to the EGR rate. That is, the fuel reforming rate becomes the maximum when the EGR rate is a predetermined value W, and decreases when the EGR rate changes in any of the increasing direction and the decreasing direction with respect to the predetermined value W. The reason why the fuel reforming rate decreases as the EGR rate increases with respect to the predetermined value W is due to the temperature decrease in the EGR gas. Specifically, as the EGR rate becomes larger than the predetermined value W, the combustion temperatures in the cylinders 2 decrease significantly, and the temperatures of the exhaust gas and consequently the EGR gas decrease. As a result, the temperature of the reforming catalyst 41 decreases, and the activation of the reforming catalyst 41 decreases relatively, so that the fuel reforming rate decreases. Furthermore, the reason why the fuel reforming rate decreases as the EGR rate decreases with respect to the predetermined value W is due to the decrease in the fuel evaporation rate. Specifically, when the EGR rate becomes smaller than the predetermined value W, the flow rate of the EGR gas flowing through the EGR passage 30 decreases significantly, and the ratio of the fuel evaporated in the EGR gas to the fuel injected from the reforming injector 32 (evaporation rate) decreases. As a result, the amount of the fuel to be introduced into the reforming catalyst 41 in a state of being sufficiently atomized decreases, so that the fuel reforming rate decreases.

As above, the change characteristic of the fuel reforming rate with respect to the EGR rate (FIG. 9) is a mountain-shaped characteristic in which the fuel reforming rate becomes the maximum at a specific EGR rate (predetermined value W). It has been found through studies by the inventors of the present application that the EGR rate (predetermined value W) at which the fuel reforming rate becomes the maximum increases as the engine load increases. Thus, in this embodiment, the target EGR rate is set to a larger value as it approaches the high load side so that as high a fuel reforming rate as possible is obtained in each operational condition (that is, so that the fuel reforming rate corresponding to the predetermined value W of FIG. 9 is obtained). It should be noted that although the target EGR rate may vary depending on the engine rotation speed, description of its tendency is omitted here.

After the target EGR rate is determined as above, the reforming controller 52 causes the motor generator 28 of the exhaust turbine device 25 to work as a generator and adjusts the electric generation amount of the motor generator 28 to a value in which the target EGR rate determined in step S31 is obtained (step S32). When the motor generator 28 works as a generator, the impeller 27 in the exhaust passage 20 (common exhaust pipe 23) becomes a resistance element that hinders the circulation of the exhaust gas, so that the pressure of the exhaust passage 20 increases. As a result, the pressure of the exhaust passage 20 becomes significantly higher than the pressure of the intake passage 10, and a sufficient amount of the EGR gas flows from the exhaust passage 20 into the intake passage 10 through the EGR passage 30. Furthermore, the flow rate of the EGR gas at this time increases as the electric generation amount of the motor generator 28 increases. In step S32, the electric generation amount of the motor generator 28 is adjusted based on such a tendency, and an amount of the EGR gas corresponding to the target EGR rate determined in step S31 flows through the EGR passage 30.

Specifically, the electric generation amount of the motor generator 28 for causing the amount of the EGR gas corresponding to the target EGR rate to flow into the EGR passage 30 can be known in advance for each engine operational condition (a combination of the load and the rotation speed) through numerical simulations, experiments, and the like. In step S32, the electric generation amount of the motor generator 28 for achieving the target EGR rate (the target EGR rate determined in step S31) under the current operational condition is calculated using a map predefined based on this known data or a model equation, and the motor generator 28 is controlled so that the electric generation amount is obtained.

Next, the reforming controller 52 determines a total fuel amount that is a total amount of fuel to be supplied to each of the cylinders 2 (step S33). Specifically, the reforming controller 52 determines the total fuel amount so that the air-fuel ratio (A/F) of the air-fuel mixture in each of the cylinders 2 coincides with a theoretical air-fuel ratio (14.7) or a target air-fuel ratio set in the vicinity thereof. The total fuel amount can be determined based on, for example, the detection value of the intake air pressure sensor SN2. That is, the reforming controller 52 estimates the intake air amount that is an amount of air (fresh air) to be introduced into each of the cylinders 2 based on the detection value of the intake air pressure sensor SN2, and determines a value in which the estimated intake air amount is divided by the target air-fuel ratio (≈14.7) as the total fuel amount.

Next, the reforming controller 52 determines a reforming fuel injection amount that is an amount of fuel to be injected from the reforming injector 32 (step S34). It should be noted that the reforming fuel injection amount referred to herein is an amount of one injection of fuel intermittently injected from the reforming injector 32 for combustion repeated in each of the cylinders 2 of the engine body 1. That is, the reforming injector 32 repeatedly injects fuel at an appropriate timing linked to an intake stroke of each of the cylinders 2 so that the fuel injected from the injector 32 reaches each of the cylinders 2 during the intake stroke of each of the cylinders 2. The reforming fuel injection amount in step S34 is an amount of one injection of fuel thus intermittently injected from the reforming injector 32.

Figure 10A:
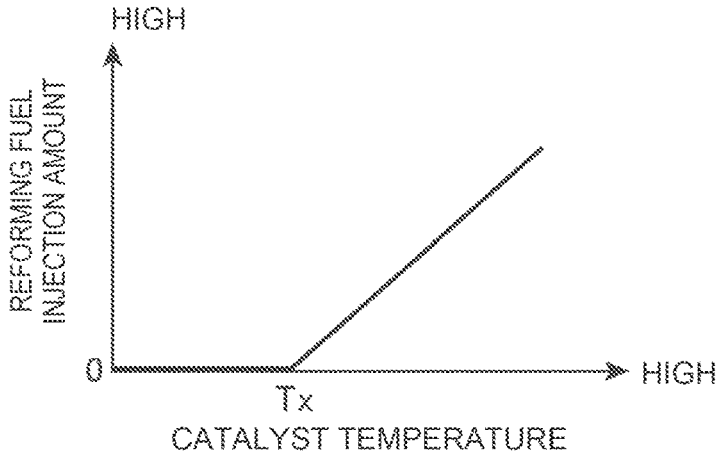
Figure 10B:
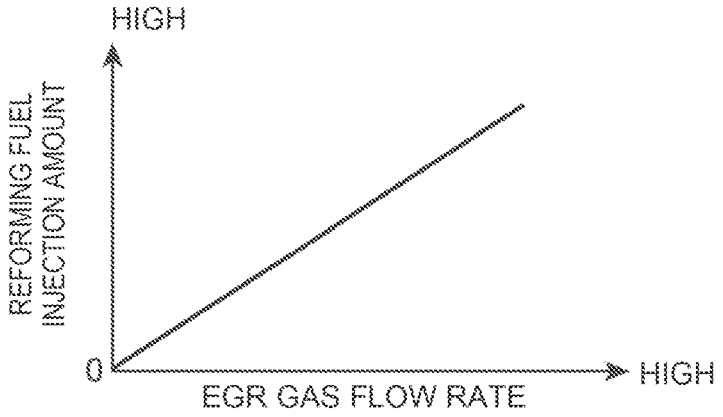

In step S34, the reforming fuel injection amount is determined based on a map in which the temperature of the reforming catalyst 41 detected by the catalyst temperature sensor SN6 and the EGR gas flow rate calculated in step S7 (FIG. 3) are used as parameters. FIGS. 10A and 10B are graphs illustrating a tendency of this map, in which FIG. 10A illustrates a relationship between the temperature of the reforming catalyst 41 (catalyst temperature) and the reforming fuel injection amount and FIG. 10B illustrates a relationship between the EGR gas flow rate and the reforming fuel injection amount. As illustrated in the graph of FIG. 10A, the reforming fuel injection amount is set so as to increase as the temperature of the reforming catalyst 41 increases with respect to the threshold value Tx described above (see step S1). Furthermore, as illustrated in the graph of FIG. 10B, the reforming fuel injection amount is set so as to increase as the EGR gas flow rate increases. It should be noted that in FIG. 10A specifying the relationship between the temperature of the reforming catalyst 41 and the injection amount, the EGR gas flow rate is constant when its value is larger than 0, and in FIG. 10B specifying the relationship between the EGR gas flow rate and the injection amount, the temperature of the reforming catalyst 41 is constant when its value is larger than the threshold value Tx.

The reason why the reforming fuel injection amount is determined by the tendency as described above is because the outlet temperature of the reforming catalyst 41 does not fall below the activation temperature. That is, the reaction of reforming fuel in the reforming catalyst 41 is an endothermic reaction; accordingly, when redundant fuel is introduced into the reforming catalyst 41, the output temperature of the reforming catalyst 41 falls below the activation temperature (for example, about 500° C.), and the fuel reforming rate in the reforming catalyst 41 might decrease. Conversely, as the output temperature of the reforming catalyst 41 increases as compared with the activation temperature, the fuel amount that can be introduced into the reforming catalyst 41 under the condition that the output temperature does not fall below the activation temperature increases. Furthermore, the temperature of the EGR gas is high, and thus as the EGR gas flow rate increases, the reforming catalyst 41 is kept warm, suppressing its temperature decrease. Thus, as the EGR gas flow rate increases, the fuel amount that can be introduced into the reforming catalyst 41 under the condition that the output temperature of the reforming catalyst 41 does not fall below the activation temperature increases. The tendency of the reforming fuel injection amount illustrated in the graphs of FIGS. 10A and 10B is defined from such a viewpoint. That is, in this embodiment, the reforming fuel injection amount is variably set according to the temperature of the reforming catalyst 41 and the EGR gas flow rate (proportional to each parameter) so that as much fuel as possible is introduced into the reforming catalyst 41 and reformed within the range in which the output temperature of the reforming catalyst 41 does not fall below the activation temperature.

After the reforming fuel injection amount is determined as described above, the reforming controller 52 determines a direct injection fuel amount that is an amount of fuel to be injected from each of the direct injectors 3 into each of the cylinders 2 of the engine body 1 (step S35). Specifically, the direct injection fuel amount is calculated based on the total fuel amount determined in step S33 according to the engine operational condition (the load and the rotation speed), that is, the amount of fuel (required fuel amount) to be injected into each of the cylinders 2 in order to generate torque conforming to the current operational direction, and the reforming fuel injection amount determined in step S34. For example, when the direct injection fuel amount is Qf1, the reforming fuel injection amount is Qf2, and the total fuel amount of each of the cylinders 2 is Qf0, the direct injection fuel amount Qf1 can be calculated as a value in which the reforming fuel injection amount Qf2 is subtracted from the total fuel amount Qf0 (Qf0−Qf2).

Figure 11:
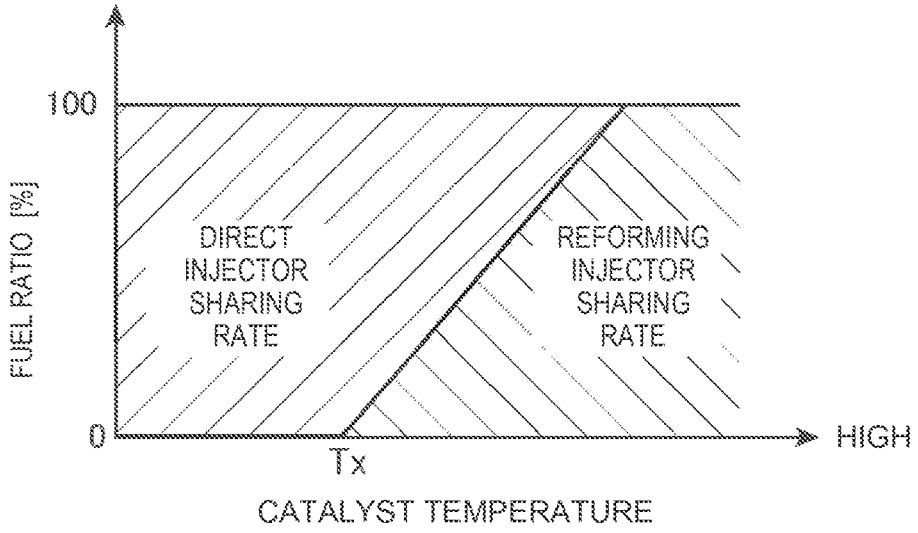
FIG. 11 is a graph illustrating a relationship between a fuel rate (a ratio of a direct injection fuel amount and a reforming fuel injection amount) and a catalyst temperature.

Here, as described above, the reforming fuel injection amount varies according to the temperature of the reforming catalyst 41 and the EGR gas flow rate, and thus the direct injection fuel amount also varies according to the temperature of the reforming catalyst 41 and the EGR gas flow rate. In other words, the ratio between the direct injection fuel amount and the reforming fuel injection amount (fuel rate) varies according to the temperature of the reforming catalyst 41 and the EGR gas flow rate. FIG. 11 is a graph illustrating a relationship between the fuel rate and the temperature of the reforming catalyst 41 (catalyst temperature). In this graph, the "direct injector sharing rate" is a ratio of the injection fuel from the direct injector 3 to the total fuel amount, and the "reforming injector sharing rate" is a ratio of the injection fuel from the reforming injector 32 to the total fuel amount. As illustrated in FIG. 11, when the temperature of the reforming catalyst 41 is less than or equal to the threshold value Tx, all (100%) of the total fuel amount is covered by the injection fuel from the direct injector 3 (direct injection fuel amount). In contrast, when the temperature of the reforming catalyst 41 exceeds the threshold value Tx, as the amount exceeding the threshold value Tx increases, the ratio of the injection fuel from the reforming injector 32 (reforming fuel injection amount) increases and reaches 100% at maximum. The ratio between the direct injection fuel amount and the reforming fuel injection amount is thus adjusted so that as the temperature of the reforming catalyst 41 increases, the ratio of the reforming fuel injection amount increases. Furthermore, this ratio also changes depending on the EGR gas flow rate and is adjusted so that as the EGR gas flow rate increases, the ratio of the reforming fuel injection amount increases, which is not illustrated in the figure. It should be noted that as the premises of steps S34 and S35, the temperature of the reforming catalyst 41 exceeds the threshold value Tx, and thus the ratio of the reforming fuel injection amount here (reforming injector sharing rate) is set to a value larger than at least 0% and can increase up to 100% at maximum.

Next, the reforming controller 52 causes the reforming injector 32 and the direct injectors 3 to inject fuel according to the respective injection amounts determined in steps S34 and S35 (step S36). That is, the reforming controller 52 controls the reforming injector 32 so that the amount of fuel corresponding to the reforming fuel injection amount determined in step S34 is injected from the reforming injector 32, and controls the direct injectors 3 so that the amount of fuel corresponding to the direct injection fuel amount determined in step S35 is injected from the direct injectors 3.

Figure 6:
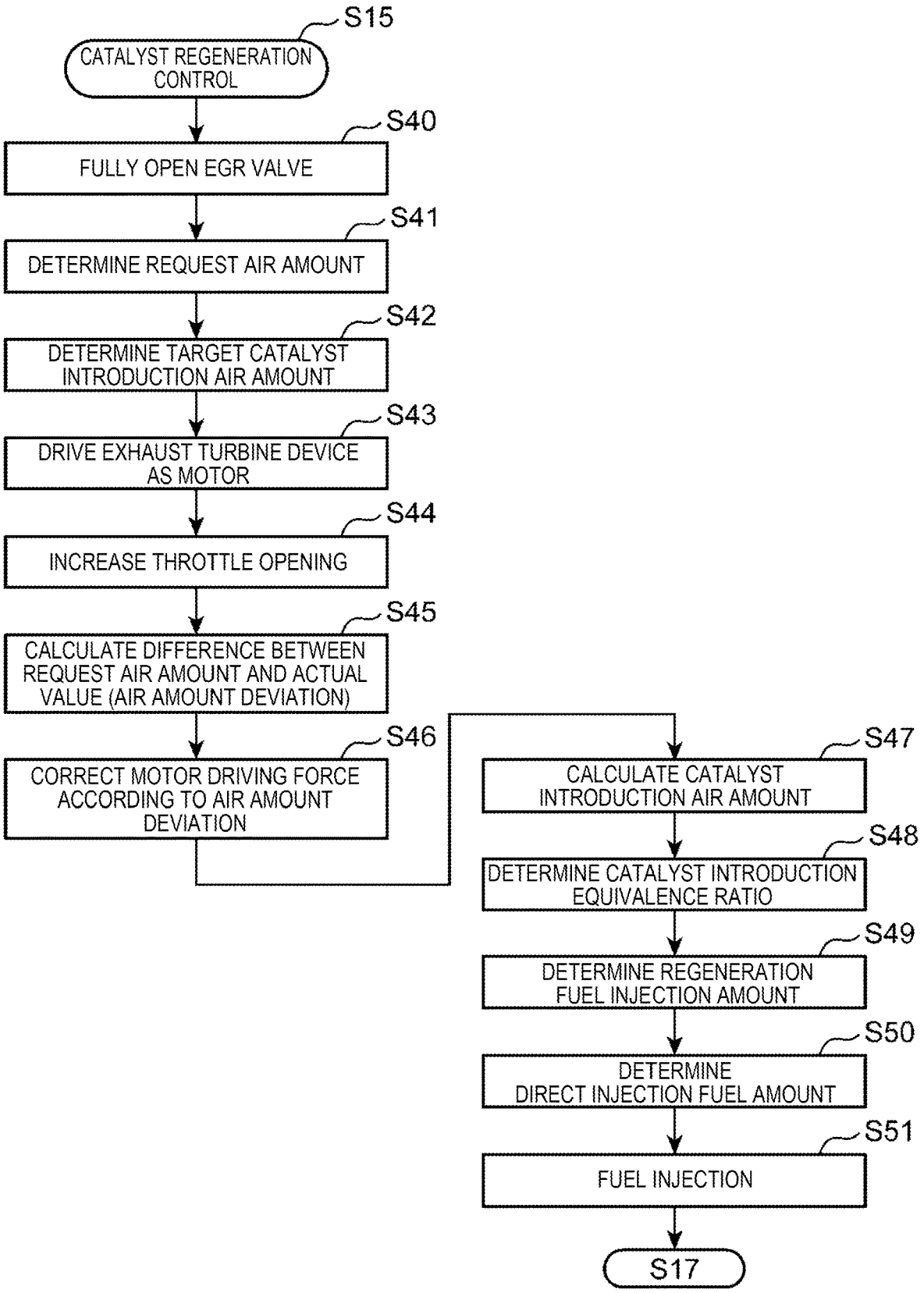
FIG. 6 is a subroutine illustrating details of fuel regeneration control performed in step S15 of FIG. 3.
Figure 14:
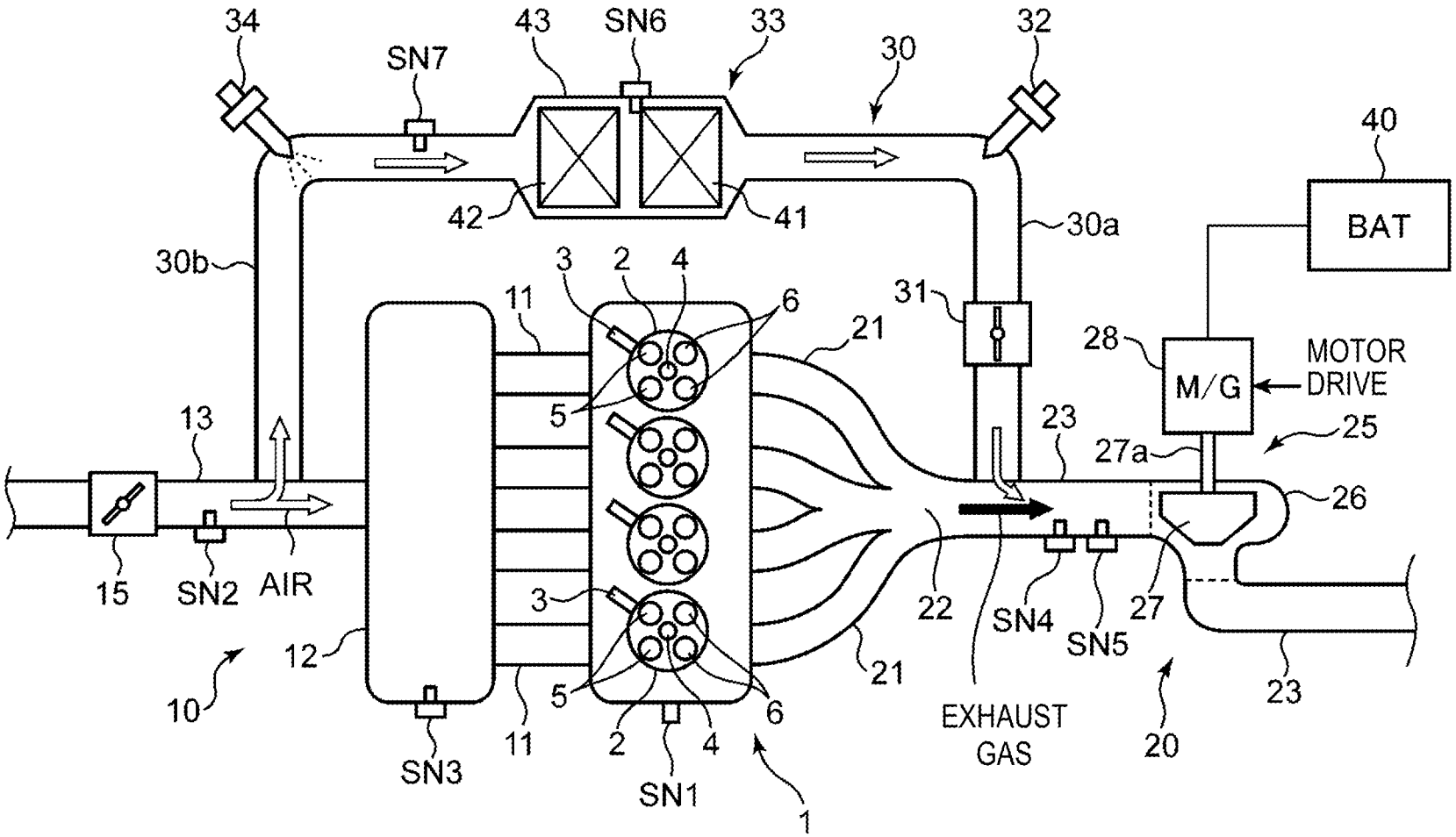
FIG. 14 is an explanatory view illustrating a flow of each passage during the catalyst regeneration control.

FIG. 6 is a subroutine illustrating details of the catalyst regeneration control of step S15 (FIG. 3). When the control illustrated in FIG. 6 starts, the regeneration controller 53 opens the EGR valve 31 to a fully open position (step S40). Here, in the catalyst regeneration control, the motor generator 28 of the exhaust turbine device 25 works as a motor in step S43 described later. As a result, the impeller 27 is rotationally driven at a high speed, and the exhaust gas in the exhaust passage 20 is sent to the downstream side by the impeller 27, so that the pressure of the exhaust passage 20 becomes lower than the pressure of the intake passage 10. In this state, the EGR valve 31 is fully opened as described above, thereby generating a flow of air flowing from the intake passage 10 to the exhaust passage 20 through the EGR passage 30 as illustrated in FIG. 14. That is, an air flow flowing through the EGR passage 30 in a direction opposite to the normal one (from the intake side to the exhaust side) is generated.

Next, the regeneration controller 53 determines a request air amount that is an amount of air to be supplied to the engine body 1 per unit time (step S41). The request air amount is determined based on the engine load identified from the detection value of the accelerator sensor SN8 or the like and the engine rotation speed identified from the detection value of the crank angle sensor SN1. Specifically, the request air amount is determined so as to increase as the engine load and the engine rotation speed increase.

Next, the regeneration controller 53 determines a target catalyst introduction air amount that is an amount of air to be introduced into the catalyst converter 33 via the EGR passage 30 (step S42). The target catalyst introduction air amount is, in other words, a target flow rate of air flowing through the EGR passage 30 from the intake side to the exhaust side as in FIG. 14. In this embodiment, the target catalyst introduction air amount is set so that a gas hourly space velocity (GHSV) that is a value in which the gas amount flowing per unit time is divided by the catalyst volume of the reforming catalyst 41 becomes a predetermined value. The predetermined value of the GHSV can be, for example, 10,000 (1/h).

Next, the regeneration controller 53 causes the motor generator 28 of the exhaust turbine device 25 to work as a motor, and the motor generator 28 rotationally drives the impeller 27 (step S43). As a result, the exhaust gas in the exhaust passage 20 is drawn by the impeller 27 and sent to the downstream side, so that the pressure of the exhaust passage 20 decreases. As a result, the pressure of the intake passage 10 becomes higher than the pressure of the exhaust passage 20, generating a flow of air flowing from the intake passage 10 to the exhaust passage 20 through the EGR passage 30 (flowing back through the EGR passage 30).

The motor generator 28 of the exhaust turbine device 25 thus works as a motor, leading to an operation of supplying air to the EGR passage 30 under the condition that the EGR valve 31 is opened. From this, a combination of the exhaust turbine device 25 and the EGR valve 31 is an example of an "air supply device" of the present disclosure that supplies air to the EGR passage 30.

A driving force (motor driving force) for causing the motor generator 28 to work as a motor in step S43 is set to a value according to the target catalyst introduction air amount determined in step S42. That is, a driving force of the motor generator 28 for causing air corresponding to the target catalyst introduction air amount to flow through the EGR passage 30 can be known in advance for each engine operational condition (a combination of the load and the rotation speed) through numerical simulations, experiments, and the like. In step S43, a driving force of the motor generator 28 for achieving the target catalyst introduction air amount under the current operational condition is calculated using a map predefined based on this known data or a model equation, and the motor generator 28 is controlled so that the driving force is obtained.

Next, the regeneration controller 53 corrects the opening of the throttle valve 15 in the increasing direction (step S44). That is, as described above, in the catalyst regeneration control, the air flows back through the EGR passage 30 due to a motor drive of the exhaust turbine device 25 (an operation of causing the motor generator 28 to work as a motor to rotate the impeller 27), so that the amount of air to be introduced into the engine body 1 decreases by the amount of this backflow air (in other words, the air dividedly flowing from the intake passage 10 into the EGR passage 30). Thus, in step S44, the opening of the throttle valve 15 is corrected in the more increasing direction than normal so that the amount of the decrease in such air is covered and a suitable amount of air (air corresponding to the request air amount determined in step S41) is introduced into the engine body 1.

Next, the regeneration controller 53 calculates an air amount deviation that is a difference between the request air amount determined in step S41 and the flow rate in the surge tank 12 detected by the air flow sensor SN3 (the amount of air actually introduced into the engine body 1) (step S45).

Next, the regeneration controller 53 corrects the driving force (motor driving force) of the motor generator 28 that works as a motor according to the air amount deviation calculated in step S45 (step S46). For example, when the actual air amount is larger than the request air amount of the engine body 1 (that is, when the air amount deviation is a plus), the driving force of the motor generator 28 is corrected in the increasing direction by increasing the air dividedly flowing into the EGR passage 30 so that the plus air amount deviation is canceled. Conversely, when the actual air amount is smaller than the request air amount of the engine body 1 (that is, when the air amount deviation is a minus), the driving force of the motor generator 28 is corrected in the decreasing direction by reducing the air dividedly flowing into the EGR passage 30 so that the minus air amount deviation is canceled. Such correction of the driving force is realized by, for example, PID control based on the air amount deviation.

Next, the regeneration controller 53 calculates a catalyst introduction air amount that is a flow rate of air introduced into the catalyst converter 33 (air passing through the EGR passage 30) (step S47). Specifically, the regeneration controller 53 estimates the flow rate of air flowing through the common intake pipe 13 based on the pressure detected by the intake air pressure sensor SN2, and identifies a value in which the flow rate in the surge tank 12 detected by the air flow sensor SN3 is subtracted from this estimated flow rate, as the catalyst introduction air amount.

Next, the regeneration controller 53 determines a catalyst introduction equivalence ratio that is an equivalence ratio of an air-fuel mixture formed by the injection fuel from the regeneration injector 34 (step S48). That is, the fuel injected from the regeneration injector 34 into the second EGR passage part 30*b* is introduced into the catalyst converter 33 while mixing with the air flowing through the second EGR passage part 30*b* from the intake side to the exhaust side. The regeneration controller 53 determines the equivalence ratio of the air-fuel mixture containing the fuel and the air that are thus introduced into the catalyst converter 33, as the catalyst introduction equivalence ratio. It should be noted that the equivalence ratio is an index representing a concentration of fuel in the air-fuel mixture and is a value in which the theoretical air-fuel ratio (A/F=14.7) is divided by the actual air-fuel ratio. The equivalence ratio being 1 means that the air-fuel ratio of the air-fuel mixture is the theoretical air-fuel ratio, and the equivalence ratio being 0 means that no fuel is contained in the air-fuel mixture (the injection amount is zero).

Figure 12:
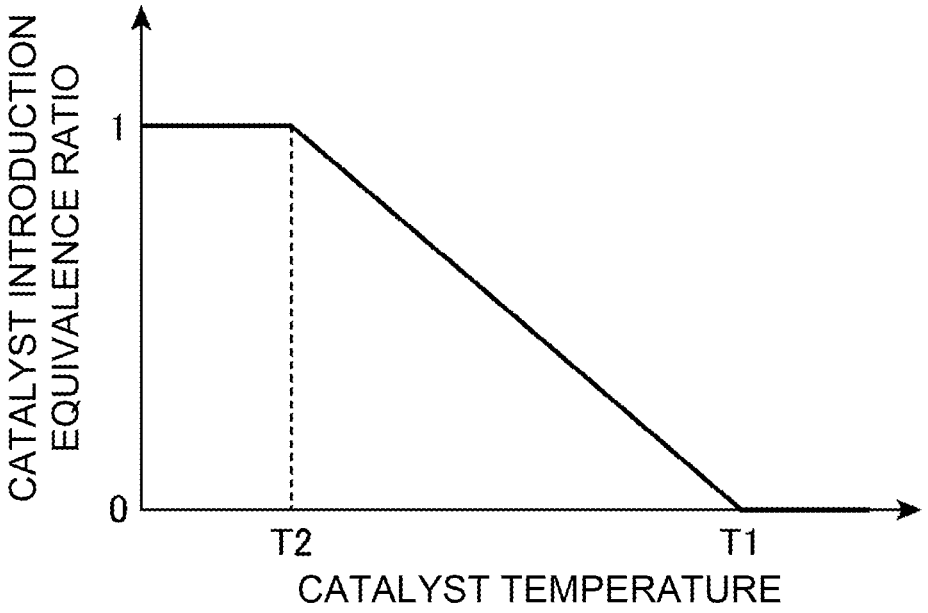
FIG. 12 is a graph illustrating a relationship between an equivalence ratio of an air-fuel mixture introduced into a reforming catalyst during the catalyst regeneration control and a catalyst temperature.

As illustrated in FIG. 12, the catalyst introduction equivalence ratio is variably set according to the temperature of the reforming catalyst 41. Specifically, the catalyst introduction equivalence ratio is uniformly set to 1 when the temperature of the reforming catalyst 41 is less than or equal to a second temperature T2, and is uniformly set to 0 when the temperature of the reforming catalyst 41 is more than or equal to a first temperature T1 that is higher than the second temperature T2. Furthermore, within a temperature range from the second temperature T2 to the first temperature T1, the catalyst introduction equivalence ratio is set so as to increase as the temperature decreases within a range from more than 0 to less than 1. In other words, as the temperature of the reforming catalyst 41 exceeding the second temperature T2 approaches the first temperature T1, the catalyst introduction equivalence ratio gradually decreases from 1 to 0. It should be noted that the second temperature T2 can be set in the vicinity of 500° C., and the first temperature T1 can be set to a value higher than the second temperature T2 by about 50° C. The first temperature T1 is sufficiently higher than the activation temperature of the reforming catalyst 41 (about 500° C.). In step S48, the regeneration controller 53 determines the catalyst introduction equivalence ratio by applying the temperature of the reforming catalyst 41 detected by the catalyst temperature sensor SN6 to a map corresponding to the graph of FIG. 12.

The reason why the catalyst introduction equivalence ratio is determined by the tendency as described above is because the temperature of the reforming catalyst 41 is held at the activation temperature (about 500° C.) or more as much as possible. That is, when the air-fuel mixture based on the injection fuel from the regeneration injector 34 is introduced into the catalyst converter 33 from the intake side (second EGR passage part 30*b*), fuel in the air-fuel mixture is oxidized in the oxidation catalyst 42, and heat in association with the oxidation reaction is generated. The reaction heat in the oxidation catalyst 42 heats the reforming catalyst 41 adjacent to the exhaust side of the oxidation catalyst 42 (the downstream side of the air flow), providing an effect of keeping the reforming catalyst 41 warm. To hold the temperature of the reforming catalyst 41 at the activation temperature or more as much as possible by using this heat keeping effect, the reaction heat in the oxidation catalyst 42 may be configured so as to increase as the amount of the increase in the temperature with respect to the activation temperature decreases. The tendency of the catalyst introduction equivalence ratio described above (FIG. 12) is set in view of such circumstances.

Next, the regeneration controller 53 determines a regeneration fuel injection amount that is an amount of fuel to be injected from the regeneration injector 34 (step S49). Specifically, the regeneration controller 53 determines the regeneration fuel injection amount so that an equivalence ratio of the air-fuel mixture coinciding with the catalyst introduction equivalence ratio determined in step S48 is formed by mixing the fuel injected from the regeneration injector 34 and the air flowing through the second EGR passage part 30*b*.

Next, the regeneration controller 53 determines a direct injection fuel amount that is an amount of fuel to be injected from each of the direct injectors 3 into each of the cylinders 2 of the engine body 1 (step S50). Specifically, the regeneration controller 53 determines the direct injection fuel amount so that the air-fuel ratio of the air-fuel mixture in each of the cylinders 2, that is, the air-fuel ratio of the air-fuel mixture formed by mixing of the fuel injected from each of the direct injectors 3 with the air introduced into each of the cylinders 2 coincides with the theoretical air-fuel ratio or a target air-fuel ratio set in the vicinity thereof.

Next, the reforming controller 52 causes the regeneration injector 34 and the direct injectors 3 to inject fuel according to the respective injection amounts determined in steps S49 and S50 (step S51). That is, the reforming controller 52 controls the regeneration injector 34 so that the amount of fuel corresponding to the regeneration fuel injection amount determined in step S49 is injected from the regeneration injector 34, and controls the direct injectors 3 so that the amount of fuel corresponding to the direct injection fuel amount determined in step S50 is injected from the direct injectors 3.

Figure 4:
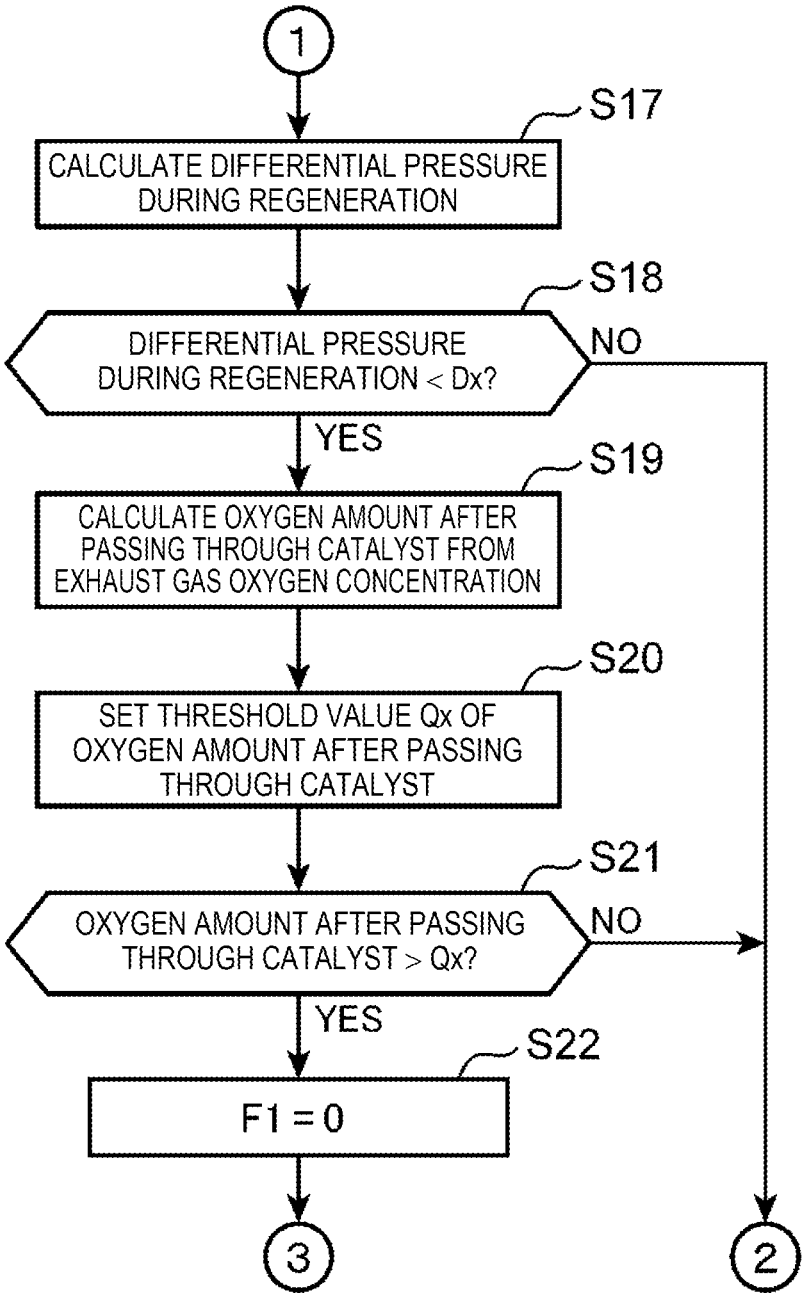
FIG. 4 is a flowchart illustrating a second half of the control.

Next, returning to a main flowchart illustrated in FIG. 4, description will be given of contents of control executed following the catalyst regeneration control. After execution of step S51 (FIG. 6) of the catalyst regeneration control, the main controller 51 calculates a differential pressure during regeneration that is a value in which the pressure detected by the exhaust gas pressure sensor SN4 is subtracted from the pressure detected by the intake air pressure sensor SN2 (step S17). That is, in the catalyst regeneration control, the air flows through the EGR passage 30 from the intake side to the exhaust side (in a direction opposite to the normal one), and thus the pressure loss that occurs in the catalyst converter 33 corresponds to a value in which the pressure of the air flowing through the exhaust side of the catalyst converter 33 (first EGR passage part 30*a*) is subtracted from the pressure of the air flowing through the intake side of the catalyst converter 33 (second EGR passage part 30*b*). Thus, in step S17, the pressure detected by the exhaust gas pressure sensor SN4 (≈the pressure of the end part of the first EGR passage part 30*a* on the exhaust side) is subtracted from the pressure detected by the intake air pressure sensor SN2 (≈the pressure of the end part of the second EGR passage part 30*b* on the intake side), and this is calculated as the differential pressure during regeneration.

Next, the main controller 51 determines whether the differential pressure during regeneration calculated in step S17 is smaller than the threshold value Dx set based on the map of FIG. 7 described above (see step S8) (step S18).

When the determination is YES in step S18 and it is confirmed that the front-rear differential pressure of the catalyst converter 33 is smaller than the threshold value Dx, the main controller 51 calculates an oxygen amount after passing through the catalyst that is an oxygen amount contained in the air after passing through the catalyst converter 33, based on the oxygen concentration in the exhaust gas detected by the $O_2$ sensor SN5 (step S19). The oxygen amount after passing through the catalyst referred to herein is an amount of oxygen which the air introduced into the EGR passage 30 from the intake side by the catalyst regeneration control contains after passing through the catalyst converter 33, more specifically, a mass of oxygen flowing through a portion of the EGR passage 30 on the exhaust side from the catalyst converter 33 (that is, the first EGR passage part 30*a*) per unit time. Here, in this embodiment, stoichiometric combustion for combusting a substantially theoretical air-fuel ratio of the air-fuel mixture in the engine body 1 (each of the cylinders 2) is executed, so that no oxygen is basically contained in the exhaust gas exhausted from the engine body 1. Thus, it can be said that the oxygen concentration detected by the $O_2$ sensor SN5 is substantially derived from only oxygen in the air led from the first EGR passage part 30*a* to the exhaust passage 20. In other words, the mass of the oxygen flowing through the first EGR passage part 30*a* per unit time, that is, the oxygen amount after passing through the catalyst is substantially the same as a mass of oxygen flowing through an installation position of the $O_2$ sensor SN5 (that is, a portion of the exhaust passage 20 on the downstream side from a connection part between the first EGR passage part 30*a* and the exhaust passage 20) per unit time. Furthermore, a mass flow rate of gas flowing through the installation position of the $O_2$ sensor SN5 corresponds to a sum of a mass flow rate of air flowing through the common intake pipe 13 and a mass of fuel supplied to the engine body 1 per unit time. From this, the main controller 51 calculates the oxygen amount after passing through the catalyst using the following formula (1).

$$Mo = Os \times (Ma + Mf) \quad (1)$$

Here, Mo is the oxygen amount after passing through the catalyst (kg/s), Os is the oxygen concentration (mass %) detected by the $O_2$ sensor SN5, Ma is the mass flow rate (kg/s) of the air in the common intake pipe 13 estimated from the detection value of the intake air pressure sensor SN2, and Mf is the mass (kg/s) of the fuel supplied to the engine body 1 per unit time.

Next, the main controller 51 sets a threshold value Qx that is compared with the oxygen amount after passing through the catalyst in step S21 described later (step S20). The threshold value Qx is set to a value corresponding to a mass of oxygen passing through the first EGR passage part 30*a* per unit time when a predetermined concentration of oxygen (for example, 20%) close to the standard concentration (a concentration of oxygen typically present in the atmosphere) is contained in the air passing through the first EGR passage part 30*a*. That is, the main controller 51 determines, as the threshold value Qx, a value in which the mass flow rate of the air passing through the first EGR passage part 30*a*, that is, the catalyst introduction air amount (kg/s) calculated in step S47 (FIG. 6) is multiplied by the predetermined concentration.

Next, the main controller 51 determines whether the oxygen amount after passing through the catalyst calculated in step S19 is larger than the threshold value Qx set in step S20 (step S21).

When the determination in either step S21 or step S18 is NO, that is, when the differential pressure during regeneration in the catalyst converter 33 is greater than equal to the threshold value Dx or when the oxygen amount after passing through the catalyst is less than or equal to the threshold value Qx, the reforming controller 52 continues the catalyst regeneration control described above (S15 of FIG. 3, or FIG. 6).

On the other hand, when the determination in step S21 is YES, the main controller 51 inputs "0" into the clogging determination flag F1 (step S22). That is, the fact that the determination in step S21 is YES (as a premise thereof, the determination in step S18 is also YES) means that the front-rear differential pressure of the catalyst converter 33 is less than the threshold value Dx and the oxygen amount after passing through the catalyst exceeds the threshold value Qx (in other words, the oxygen consumption amount in the reforming catalyst 41 is decreasing). These events all provide a basis for estimating that there are few deposits in the reforming catalyst 41. Thus, the main controller 51 performs the setting in step S22 in which the clogging determination flag F1=0, and records that the amount of the deposits in the reforming catalyst 41 is less than or equal to the acceptable level. After this process, the flow shifts to the fuel reforming control described above (S13 of FIG. 3, or FIG. 5).

(4) Operation and Effects

As described above, in the above embodiment, the reforming catalyst 41 is provided at an intermediate part of the EGR passage 30 and the reforming injector 32 is provided at a portion of the EGR passage 30 on the exhaust side from the reforming catalyst 41 (first EGR passage part 30*a*), and thus hydrocarbon fuel (fuel containing gasoline) injected from the reforming injector 32 is reformed by being introduced into the reforming catalyst 41 together with EGR gas, so that components containing hydrogen ($H_2$) can be generated. The reformed fuel containing hydrogen is high in combustion speed and has a large heat generation amount per unit mass, as compared with the fuel before reforming (hydrocarbon fuel). This brings an effect of reducing the total amount of fuel necessary for generating the same output torque. Moreover, the reforming reaction in the reforming catalyst 41 is an endothermic reaction, and thus heat of the EGR gas (exhaust gas) is used for generation of hydrogen, so that an effect of reducing discharged heat from the engine to the output (discharged heat collecting effect) is obtained.

However, when fuel reforming by the reforming catalyst 41 is continued, many deposits such as solid carbon are deposited in the interior of the reforming catalyst 41, which brings a concern that the performance of the reforming catalyst 41 decreases significantly. To cope with this, in the above embodiment, a presence or absence of clogging in the reforming catalyst 41 (accumulation of the deposits exceeding the acceptable level) is determined based on the front-rear differential pressure of the catalyst converter 33 including the reforming catalyst 41, or the like, and when generation of the clogging is confirmed, the catalyst regeneration control for opening the EGR valve 31 and causing the motor generator 28 of the exhaust turbine device 25 to work as a motor (S15 of FIG. 3, or FIG. 6) is executed. When the motor generator 28 works as a motor, the impeller 27 coupled to the motor generator 28 rotates in the exhaust passage 20 at a high speed to draw exhaust gas in the exhaust passage 20 and send the exhaust gas to the downstream side. As a result, the pressure of the exhaust passage 20 decreases, and an air flow reaching the exhaust passage 20 from the intake passage 10 through the EGR passage 30 (that is, flowing back through the EGR passage 30) is generated, so that oxygen contained in the air flow can be caused to react with the deposits in the reforming catalyst 41 to combust and remove the deposits, and quick regeneration of the reforming catalyst 41 can be achieved.

On the other hand, when the catalyst regeneration control is unnecessary, the motor generator 28 is caused to work as a generator, so that a part of the energy of the exhaust gas can be collected as electric power. This enhances the efficiency of discharged heat collection for reducing discharged heat from the engine to the output, in cooperation with the effect of fuel reforming due to the endothermic reaction in the reforming catalyst 41 (improvement of the combustibility). Furthermore, the electric power thus collected from the energy of the exhaust gas can be supplied to the motor generator 28 that works as a motor during the catalyst regeneration control, and thus different from when, for example, only electric power generated by an alternator associated with the output shaft of the engine body 1 (that is, electric power directly obtained from the engine output) is the electric power source, an influence of energy consumption during the catalyst regeneration control on the fuel consumption performance can be minimized. As above, the engine fuel consumption performance can be enhanced sufficiently.

Furthermore, in the above embodiment, the regeneration injector 34 is provided at a portion of the EGR passage 30 on the intake side from the reforming catalyst 41 (second EGR passage part 30*b*), and the fuel injection amount from the regeneration injector 34 is variably set during the catalyst regeneration control according to the temperature of the reforming catalyst 41 detected by the catalyst temperature sensor SN6. Specifically, when the temperature of the reforming catalyst 41 is less than the first temperature T1 that is higher than the activation temperature (about 500° C.), fuel is injected from the regeneration injector 34 and the injection fuel is introduced into the catalyst converter 33 together with air flowing through the EGR passage 30, and when the temperature of the reforming catalyst 41 is greater than or equal to the first temperature T1, the fuel injection of the regeneration injector 34 is stopped (that is, only air is supplied to the catalyst converter 33). Hereinafter, the catalyst regeneration control performed under the temperature condition of less than the first temperature T1, that is, the catalyst regeneration control associated with the fuel injection of the regeneration injector 34 is referred to as first catalyst regeneration control, and the catalyst regeneration control performed under the temperature condition of greater than or equal to the first temperature T1, that is, the catalyst regeneration control not associated with the fuel injection of the regeneration injector 34 is referred to as second catalyst regeneration control. By the proper use of the first and second catalyst regeneration control, in the above embodiment, an advantage is obtained that highly efficient catalyst regeneration can be achieved while the fuel consumption amount is suppressed.

That is, in the above embodiment, when the temperature of the reforming catalyst 41 is less than the first temperature T1, the first catalyst regeneration control for causing the regeneration injector 34 to inject fuel is executed; accordingly, the injection fuel from the regeneration injector 34 is oxidized in the oxidation catalyst 42 disposed adjacent to the intake side of the reforming catalyst 41, so that the reforming catalyst 41 can be heated by the reaction heat. As a result, the deposits in the reforming catalyst 41 can be combusted and removed under a relatively high-temperature environment, so that the efficiency of the combustion and removal can be maintained satisfactorily, and a time required for reducing the amount of the deposits to a desired level (that is, required time for catalyst regeneration) can be shortened.

On the other hand, when the temperature of the reforming catalyst 41 is greater than or equal to the first temperature T1, the second catalyst regeneration control for stopping the fuel injection of the regeneration injector 34 is executed, so that the fuel can be avoided from being wastefully injected in a situation where the temperature of the reforming catalyst 41 is sufficiently high, and an increase in the fuel consumption amount in association with the catalyst regeneration can be suppressed.

In particular, in the above embodiment, during execution of the first catalyst regeneration control, the fuel injection amount of the regeneration injector 34 is controlled so that the equivalence ratio of the air-fuel mixture formed by the injection fuel from the regeneration injector 34, that is, the catalyst introduction equivalence ratio progressively increases as the temperature of the reforming catalyst 41 progressively lowers with respect to the first temperature T1 (as it approaches the second temperature T2) (see FIG. 12). This means that as the range of the decrease in the temperature with respect to the first temperature T1 increases, the reaction heat in the oxidation catalyst 42 is increased. As a result, a possibility that the temperature of the reforming catalyst 41 greatly falls below the first temperature T1 is reduced as much as possible, so that the effect described above such as shortening of the required time for catalyst regeneration can be obtained more reliably.

More specifically, the catalyst introduction equivalence ratio during the first catalyst regeneration control is uniformly set to 1 when the temperature of the reforming catalyst 41 is less than or equal to the second temperature T2 that is lower than the first temperature T1, and is gradually reduced toward 0 as the temperature of the reforming catalyst exceeding the second temperature approaches the first temperature, so that a suitable amount of fuel according to the temperature conditions can be caused to react in the oxidation catalyst 42 to heat the reforming catalyst 41, and a suitable heat keeping effect can be brought to the reforming catalyst 41 while the fuel consumption amount is suppressed to the necessary minimum.

Furthermore, in the above embodiment, the first temperature T1 at which a necessity of the fuel injection of the regeneration injector 34 is switched is set to a temperature higher than the activation temperature of the reforming catalyst 41 (about 500° C.), so that the reaction heat in the oxidation catalyst 42 can be exerted on the reforming catalyst 41 before the temperature of the reforming catalyst 41 decreases to the activation temperature, and the possibility that the reforming catalyst 41 falls below the activation temperature can be reduced as much as possible. As a result, after the end of the catalyst regeneration control, shifting to the control for reforming fuel in the reforming catalyst 41 (fuel reforming control) can be made quickly, so that as long a time as possible for performing an operation using reformed fuel excellent in combustibility can be secured, and the engine fuel consumption performance can be improved sufficiently.

(5) Modification

Although in the above embodiment, on the premise that an engine is used in which stoichiometric combustion for combusting a substantially theoretical air-fuel ratio of an air-fuel mixture in the engine body 1 (cylinders 2) is performed, at the time of the catalyst regeneration control for combusting and removing deposits in the reforming catalyst 41, an air flow flowing through the EGR passage 30 from the intake side to the exhaust side is generated by the exhaust turbine device 25 and the like, and oxygen contained in this air flow is supplied to the reforming catalyst 41 to combust and remove the deposits (see FIG. 14), the method of supplying air (oxygen) to the reforming catalyst 41 is not limited to this. For example, in an engine capable of combusting a sufficiently leaner air-fuel mixture than the theoretical air-fuel ratio in the engine body 1 (cylinders 2), exhaust gas containing air (oxygen) that occurs due to this lean combustion is introduced from the exhaust passage 20 into the EGR passage 30, so that the air can be introduced into the reforming catalyst 41.

Figure 15:
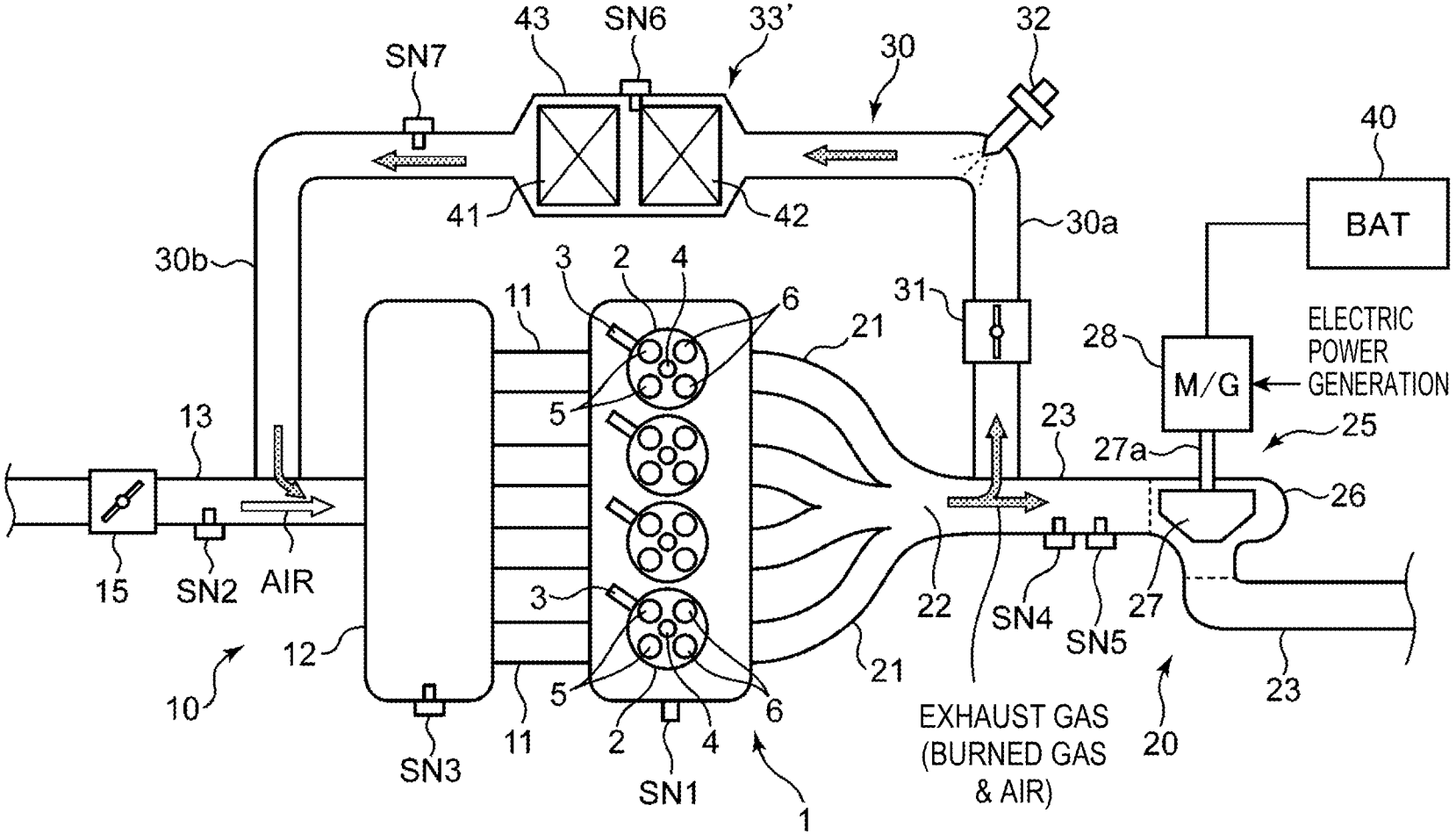
FIG. 15 is a view corresponding to FIG. 14 for describing a modification of the embodiment.

FIG. 15 is a view corresponding to FIG. 14 which illustrates a flow of the air in the above modification. In the modification illustrated in FIG. 15, the injector 32 is provided at only a portion of the EGR passage 30 on the exhaust side from a catalyst converter 33' (first EGR passage part 30*a*), and no injector is provided at a portion of the EGR passage 30 on the intake side from the catalyst converter 33' (second EGR passage part 30*b*). That is, the regeneration injector 34 used in the above embodiment (FIGS. 1 to 14) is omitted. Furthermore, the reforming catalyst 41 and the oxidation catalyst 42 in the catalyst converter 33' are disposed in the opposite order of the above embodiment, that is, such that the reforming catalyst 41 and the oxidation catalyst 42 are arranged in this order from the intake side.

In the modification of FIG. 15, when it is determined that clogging in the reforming catalyst 41 is present, lean combustion for combusting a sufficiently leaner air-fuel mixture than the theoretical air-fuel ratio is performed in the engine body 1 (cylinders 2). Furthermore, in this state, the EGR valve 31 is opened to a fully open position, and the motor generator 28 of the exhaust turbine device 25 is caused to work as a generator. As a result, a relatively large amount of exhaust gas is introduced from the exhaust passage 20 into the EGR passage 30. That is, the exhaust gas return operation is realized in which the exhaust gas is returned from the exhaust passage 20 to the intake passage 10 through the EGR passage 30. However, since lean combustion is performed in the engine body 1 as above, the exhaust gas flowing through the EGR passage 30 (EGR gas) contains burned gas that occurs due to combustion of the air-fuel mixture and air that has not been used for combustion. Accordingly, air (oxygen) is supplied to the reforming catalyst 41 while the exhaust gas return operation is performed as above. As a result, the deposits in the reforming catalyst 41 react (combust) with the oxygen and are removed, so that the catalyst regeneration control is realized.

Furthermore, during execution of the catalyst regeneration control in which the lean combustion and the exhaust gas return operation as above are combined, fuel is appropriately injected from the injector 32 according to the temperature of the reforming catalyst 41. That is, when the temperature of the reforming catalyst 41 is lower than a predetermined temperature (a temperature corresponding to the first temperature T1 of FIG. 12), fuel is injected from the injector 32, and when the temperature of the reforming catalyst 41 is greater than or equal to the predetermined temperature, the fuel injection is stopped. When fuel is injected from the injector 32, the injected fuel is oxidized in the oxidation catalyst 42. The reaction heat in association with this oxidation heats the reforming catalyst 41 present on the intake side from the oxidation catalyst 42 (the downstream side in the flow direction of the EGR gas), and thereby the reforming catalyst 41 is kept warm.

(6) Other Modifications

Last, modifications other than the example illustrated in FIG. 15 will be described together.

Although in the above embodiments (FIGS. 1 to 14), the reforming catalyst 41 and the oxidation catalyst 42 are disposed so as to be adjacent to each other in the pipe axis direction of the EGR passage 30, it is sufficient that both of these catalysts are close to each other such that oxidation reaction heat in the oxidation catalyst 42 is exerted on the reforming catalyst 41; accordingly, the reforming catalyst 41 and the oxidation catalyst 42 may be disposed so as to be adjacent to each other in a direction orthogonal to the pipe axis direction, for example.

Although in the above embodiment, during execution of the fuel reforming control for reforming fuel injected from the reforming injector 32 in the reforming catalyst 41, the front-rear differential pressure of the catalyst converter 33 including the reforming catalyst 41 and the fuel reforming rate of the reforming catalyst 41 are checked, and when both of the condition that the front-rear differential pressure is larger than the threshold value Dx (first condition) and the condition that the fuel reforming rate is smaller than the threshold value Rx (second condition) are established, it is determined that clogging in the reforming catalyst 41 is occurring (it is necessary to perform the catalyst regeneration control for reducing the deposits in the reforming catalyst 41), the method of determining clogging in the reforming catalyst 41 is not limited to this. For example, clogging in the reforming catalyst 41 may be determined based on only either one of the front-rear differential pressure and the fuel reforming rate (that is, based on only establishment of either one of the first and second conditions).

Alternatively, the second condition using the fuel reforming rate as an index may be replaced with a condition using the hydrogen concentration detected by the hydrogen sensor SN7 as an index. That is, a condition that the hydrogen concentration detected by the hydrogen sensor SN7 is lower than a predetermined threshold value may be set as the second condition.

Although in the above embodiment, the front-rear differential pressure of the catalyst converter 33 during the fuel reforming control is calculated by subtracting the pressure of the intake passage 10 detected by the intake air pressure sensor SN2 (≈the pressure of the end part of the second EGR passage part 30*b* on the intake side) from the pressure of the exhaust passage 20 detected by the exhaust gas pressure sensor SN4 (≈the pressure of the end part of the first EGR passage part 30*a* on the exhaust side), the method of identifying the front-rear differential pressure is not limited to this. For example, the front-rear differential pressure may be identified by using a sensor that directly detects a difference between the pressure of gas immediately before introduced into the catalyst converter 33 and the pressure of gas immediately after led from the catalyst converter 33 (a difference between the pressure of the first EGR passage part 30*a* and the pressure of the second EGR passage part 30*b*). The same applies to a case of calculating the differential pressure during regeneration that is a difference in pressure between the first and second EGR passage parts 30*a* and 30*b* during the catalyst regeneration control.

Although in the above embodiment, the $O_2$ sensor SN5 (oxygen sensor) is provided at a portion of the exhaust passage 20 (common exhaust pipe 23) on the downstream side from the connection part between the EGR passage 30 and the exhaust passage 20, and an end timing of the catalyst regeneration control is determined based on the oxygen concentration detected by the $O_2$ sensor SN5 or the like, an oxygen concentration that needs to be detected for determination of the timing may be a concentration of oxygen contained in the air after passing through at least the catalyst converter 33 (reforming catalyst 41). Thus, a similar $O_2$ sensor may be provided at a portion of the EGR passage 30 on the exhaust side from the catalyst converter 33 (that is, the first EGR passage part 30*a*).

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

REFERENCE CHARACTERS LIST

1 engine body
10 intake passage
15 throttle valve
20 exhaust passage
25 exhaust turbine device
27 impeller
28 motor generator
30 EGR passage
31 EGR valve
32 reforming injector
34 regeneration injector
41 reforming catalyst
42 oxidation catalyst
51 main controller
53 regeneration controller
SN6 catalyst temperature sensor

The invention claimed is:

1. An engine fuel reforming system that is applied to an engine and reforms fuel to be supplied to an engine body, the engine comprising: the engine body; an intake passage through which intake air to be introduced into the engine body flows; an exhaust passage through which exhaust gas exhausted from the engine body flows; and an exhaust gas recirculation (EGR) passage connecting the intake passage and the exhaust passage, the engine fuel reforming system comprising:

a fuel injection device configured to inject fuel into the EGR passage;

a reforming catalyst provided in the EGR passage and configured to reform the fuel injected from the fuel injection device;

an oxidation catalyst provided in a vicinity of the reforming catalyst in the EGR passage;

an air supply device that supplies air to the EGR passage;

a catalyst temperature sensor that detects a temperature of the reforming catalyst; and a processor configured to execute:

a main controller that determines whether clogging in which deposits exceeding an acceptable level are accumulated in an interior of the reforming catalyst is occurring; and a regeneration controller that controls the fuel injection device and the air supply device, wherein when it is determined by the main controller that the clogging in the reforming catalyst is present, and the temperature of the reforming catalyst detected by the catalyst temperature sensor is less than a predetermined first temperature, the regeneration controller performs a first catalyst regeneration control for driving the air supply device so that the air is supplied to the EGR passage, and causing the fuel injection device to inject the fuel so that the fuel injected from the fuel injection device is introduced into the reforming catalyst together with the air, and when it is determined by the main controller that the clogging in the reforming catalyst is present, and the temperature of the reforming catalyst is greater than or equal to the first temperature, the regeneration controller performs a second catalyst regeneration control for driving the air supply device so that the air is supplied to the EGR passage, and stopping the fuel injection by the fuel injection device.

2. The engine fuel reforming system according to claim 1, wherein the air supply device comprises:

an exhaust turbine device including an impeller provided in the exhaust passage and a motor generator coupled to the impeller; and an EGR valve configured to open and close, provided in the EGR passage, the reforming catalyst is provided adjacent to an exhaust side of the oxidation catalyst, and during performance of the first and second catalyst regeneration control, the regeneration controller opens the EGR valve and causes the motor generator to work as a motor.

3. The engine fuel reforming system according to claim 1, wherein the main controller determines that the clogging in the reforming catalyst is present when a front-rear differential pressure of a catalyst converter including the reforming catalyst and the oxidation catalyst is less than or equal to a threshold value or when a fuel reforming rate is greater than or equal to a threshold value.

4. The engine fuel reforming system according to claim 1, wherein during performance of the first catalyst regeneration control, the regeneration controller progressively increases a fuel injection amount from the fuel injection device as the temperature of the reforming catalyst progressively lowers with respect to the first temperature.

5. The engine fuel reforming system according to claim 4, wherein the air supply device comprises:

an exhaust turbine device including an impeller provided in the exhaust passage and a motor generator coupled to the impeller; and an EGR valve configured to open and close, provided in the EGR passage, the reforming catalyst is provided adjacent to an exhaust side of the oxidation catalyst, and during performance of the first and second catalyst regeneration control, the regeneration controller opens the EGR valve and causes the motor generator to work as a motor.

6. The engine fuel reforming system according to claim 4, wherein during performance of the first catalyst regeneration control, the regeneration controller adjusts the fuel injection amount from the fuel injection device so that a catalyst introduction equivalence ratio that is an equivalence ratio of an air-fuel mixture containing the air and the fuel to be introduced from the fuel injection device into the reforming catalyst changes according to the temperature of the reforming catalyst, and the catalyst introduction equivalence ratio is uniformly set to 1 when the temperature of the reforming catalyst is less than or equal to a second temperature that is lower than the first temperature, and is gradually reduced toward zero as the temperature of the reforming catalyst exceeding the second temperature approaches the first temperature.

7. The engine fuel reforming system according to claim 6, wherein the air supply device comprises:

an exhaust turbine device including an impeller provided in the exhaust passage and a motor generator coupled to the impeller; and an EGR valve configured to open and close, provided in the EGR passage, the reforming catalyst is provided adjacent to an exhaust side of the oxidation catalyst, and during performance of the first and second catalyst regeneration control, the regeneration controller opens the EGR valve and causes the motor generator to work as a motor.

8. The engine fuel reforming system according to claim 6, wherein the first temperature is higher than an activation temperature of the reforming catalyst.

9. The engine fuel reforming system according to claim 8, wherein the air supply device comprises:

an exhaust turbine device including an impeller provided in the exhaust passage and a motor generator coupled to the impeller; and an EGR valve configured to open and close, provided in the EGR passage, the reforming catalyst is provided adjacent to an exhaust side of the oxidation catalyst, and during performance of the first and second catalyst regeneration control, the regeneration controller opens the EGR valve and causes the motor generator to work as a motor.

10. The engine fuel reforming system according to claim 9, wherein the fuel injection device comprises:

a reforming injector provided at a portion of the EGR passage on an exhaust side from the reforming catalyst; and a regeneration injector provided at a portion of the EGR passage on an intake side from the oxidation catalyst, and during performance of the first catalyst regeneration control, the regeneration controller stops fuel injection of the reforming injector and causes the regeneration injector to inject fuel.

* * * * *